US008984685B2

(12) United States Patent
Robertson et al.

(10) Patent No.: US 8,984,685 B2
(45) Date of Patent: Mar. 24, 2015

(54) PATIENT SUPPORT APPARATUS AND CONTROLS THEREFOR

(71) Applicant: Stryker Corporation, Kalamazoo, MI (US)

(72) Inventors: Donna-Marie Robertson, Portage, MI (US); Rohit Subramanian, San Jose, CA (US); Thomas Joseph Newport, II, Kalamazoo, MI (US); Richard Thomas Deluca, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 13/767,943

(22) Filed: Feb. 15, 2013

(65) Prior Publication Data

US 2013/0205501 A1 Aug. 15, 2013

Related U.S. Application Data

(60) Provisional application No. 61/599,099, filed on Feb. 15, 2012.

(51) Int. Cl.
*A47B 7/00* (2006.01)
*A61G 7/018* (2006.01)
(Continued)

(52) U.S. Cl.
CPC ..... *A61G 7/018* (2013.01); *A61G 7/015* (2013.01); *A61G 2007/0524* (2013.01); *A61G 2203/10* (2013.01); *A61G 2203/12* (2013.01); *A61G 2203/30* (2013.01); *A61G 2203/32* (2013.01);
(Continued)

(58) Field of Classification Search
USPC ..... 5/611, 613, 617
See application file for complete search history.

(56) References Cited

U.S. PATENT DOCUMENTS 4,988,982 A 1/1991 Rayner et al.
5,235,258 A 8/1993 Schuerch
(Continued)

FOREIGN PATENT DOCUMENTS

JP 2003216176 7/2003

OTHER PUBLICATIONS

PCT International Search Report regarding Application No. PCT/US2013/026039 filed Feb. 14, 2013, a counterpart to U.S. Appl. No. 13/767,943.
(Continued)

*Primary Examiner* — Robert G Santos
*Assistant Examiner* — Richard G Davis
(74) *Attorney, Agent, or Firm* — Warner Norcross & Judd LLP

(57) ABSTRACT

A patient support apparatus system includes sensors adapted to sense a gesture of a person, or forces exerted by the person on the patient support apparatus, and to control the movement of a component of the patient support apparatus based on the gesture or forces. The movement of the patient support apparatus matches the direction of the person's gesture or applied forces. The speed of the gesture and magnitude of the applied force also influence the movement of the patient support apparatus component. The controlled movement may be the upward and downward motion of a patient support deck on the patient support apparatus, or it may be the pivoting of a section of the patient support deck, or it may be other movement. Control of the patient support apparatus is carried out based on the intent of the user, as evidenced by the user's gesture or applied forces.

24 Claims, 12 Drawing Sheets

(51) Int. Cl.
*A61G 7/015* (2006.01)
*A61G 7/05* (2006.01)

(52) U.S. Cl.
CPC ..... *A61G 2203/44* (2013.01); *A61G 2205/60* (2013.01); *A61G 2203/36* (2013.01)
USPC ..... 5/611; 5/613; 5/617

(56) References Cited

U.S. PATENT DOCUMENTS

| | | | | |
|---|---|---|---|---|
| 5,969,488 | A | 10/1999 | Fromson | |
| 6,426,740 | B1 | 7/2002 | Goto et al. | |
| 6,481,688 | B1 | 11/2002 | Welling et al. | |
| 6,526,606 | B2 | 3/2003 | Friedrich | |
| 6,560,804 | B2 | 5/2003 | Wise et al. | |
| 6,580,246 | B2 | 6/2003 | Jacobs | |
| 6,601,583 | B2 | 8/2003 | Pessala et al. | |
| 6,761,344 | B2 | 7/2004 | Welling et al. | |
| 6,781,517 | B2 | 8/2004 | Moster et al. | |
| 6,871,720 | B2 | 3/2005 | Hauer et al. | |
| 7,191,854 | B2 | 3/2007 | Lenkman | |
| 7,454,987 | B2 | 11/2008 | Reger | |
| 7,472,440 | B2 | 1/2009 | Bartlett et al. | |
| 7,500,280 | B2 * | 3/2009 | Dixon et al. | 5/713 |
| 7,519,223 | B2 | 4/2009 | Dehlin et al. | |
| 7,561,708 | B2 | 7/2009 | Rohrlein | |
| 7,603,744 | B2 | 10/2009 | Reindle | |
| 7,702,481 | B2 | 4/2010 | Dionne et al. | |
| 7,781,941 | B2 | 8/2010 | Horvath et al. | |
| 7,828,092 | B2 | 11/2010 | Vogel et al. | |
| 7,833,179 | B2 | 11/2010 | Filtvedt et al. | |
| 7,845,441 | B2 | 12/2010 | Chambers | |
| 7,861,334 | B2 | 1/2011 | Lemire et al. | |
| 7,884,735 | B2 | 2/2011 | Newkirk | |
| 8,260,517 | B2 * | 9/2012 | Bhai | 701/70 |
| 2002/0014951 | A1 | 2/2002 | Kramer et al. | |
| 2004/0104948 | A1 | 6/2004 | Schockmel et al. | |
| 2006/0058587 | A1 | 3/2006 | Heimbrock et al. | |
| 2006/0101581 | A1 | 5/2006 | Blanchard et al. | |
| 2006/0117482 | A1 | 6/2006 | Branson | |
| 2007/0169268 | A1 * | 7/2007 | Lemire et al. | 5/617 |
| 2007/0200396 | A1 * | 8/2007 | Baumann et al. | 297/135 |
| 2008/0098525 | A1 * | 5/2008 | Doleschal et al. | 5/600 |
| 2008/0120784 | A1 | 5/2008 | Warner et al. | |
| 2008/0235872 | A1 | 10/2008 | Newkirk et al. | |
| 2009/0049610 | A1 | 2/2009 | Heimbrock et al. | |
| 2009/0060268 | A1 | 3/2009 | Roberts et al. | |
| 2009/0085718 | A1 | 4/2009 | Hamel et al. | |
| 2009/0100599 | A1 | 4/2009 | Rawls-Meehan | |
| 2009/0109025 | A1 | 4/2009 | Riley et al. | |
| 2009/0143703 | A1 * | 6/2009 | Dixon et al. | 600/587 |
| 2009/0188042 | A1 | 7/2009 | Derenne et al. | |
| 2011/0004276 | A1 | 1/2011 | Blair et al. | |
| 2011/0083272 | A1 | 4/2011 | Childs et al. | |
| 2011/0140869 | A1 | 6/2011 | Liu et al. | |

OTHER PUBLICATIONS

PCT Written Opinion regarding Application No. PCT/US2013/026039 filed Feb. 14, 2013, a counterpart to U.S. Appl. No. 13/767,943.

* cited by examiner

PATIENT SUPPORT APPARATUS AND CONTROLS THEREFOR

This application claims priority to U.S. provisional patent application Ser. No. 61/599,099 filed Feb. 15, 2012 by applicants Donna-Marie Robertson et al. and entitled PATIENT SUPPORT APPARATUS AND CONTROLS THEREFOR, the complete disclosure of which is hereby incorporated herein by reference.

BACKGROUND OF THE INVENTION

The present invention relates to patient support apparatuses, and more particularly to systems and methods for controlling one or more functions of the patient support apparatuses.

Patient support apparatuses are used in a variety of different settings within health care environments. Such patient support apparatuses may include beds, stretchers, cots, operating tables, support tables, patient recliners, and other structures used to support a patient. Patient support apparatuses include a number of different aspects that may be controlled by either the patient or a caregiver. Such aspects include controlling the physical movement of one or more components of the apparatus, controlling the electronics on the support apparatus, controlling one or more settings on the support apparatus, and/or controlling the communication of the support apparatus with other devices.

Typically, the controls for controlling the physical movement of one or more aspects of the patient support apparatus are located on one or more control panels positioned on the patient support apparatus. One example of this can be seen in commonly assigned, U.S. patent publication 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION. In many cases, a control panel is positioned on one or more siderails of the patient support apparatus so that both a caregiver and a patient may access the controls to thereby move the support apparatus to the desired orientation and/or position. A control panel is commonly also located at the foot end of the patient support apparatus where a caregiver can control various aspects of the patient support apparatus. The foot end controls are typically not easily accessible by a patient, and may include controls that are not intended to be accessed by the patient. In still other situations, a pendant or pedestal may be supplied on the patient support apparatus that includes buttons or the like for controlling various aspects of the patient support apparatus.

SUMMARY OF THE INVENTION

The present invention generally relates to improving the ease of use of one or more controls on the patient support apparatus, and/or configuring such controls in a manner that provides better infection containment. In some embodiments, the ease of using the controls may be provided by having the patient support apparatus controlled through gestures or motions that correspond to the specific aspect being controlled. In some embodiments, the containment and/or control of infection may be improved by having the control be achieved without requiring contact with the patient support apparatus, and/or by reducing the amount of contact that might otherwise be necessary. The reduction or elimination of such contact reduces the chances of infectious agents being transmitted to or from the patient support apparatus.

In still other embodiments, the location of one or more controls is moved such that, instead of being exclusively located on a dedicated control panel, the one or more controls are positioned on the patient support apparatus in locations that more naturally correspond to the movement or functionality that is to be controlled. In some embodiments, this changed location allows the functionality or movement to be controlled by moving or pressing a component in the direction in which motion is desired. In general, the control of the patient support apparatus may be based upon the intent of the person controlling the support apparatus, as determined by one or more of the following: the force the person is applying, the location the force is being applied; and/or the movement of the person in control.

According to one embodiment of the present invention, a patient support system is provided that includes a frame, a patient support surface supported thereon, at least one control, and a controller. The patient support surface is adapted to support a patient. The control is adapted to generate a control signal based upon movement of a portion of a person's body wherein the movement does not make any contact with any portion of the patient support apparatus. The controller communicates with the control and is adapted to control an aspect of the patient support apparatus based upon the control signal.

According to other aspects, the controller may be positioned on the patient support apparatus while the control is adapted to be carried by a caregiver. The control and the controller may communicate with each other wirelessly. In some embodiment, the control may be worn by a caregiver. A switch may be included for the control that enables a caregiver to select between controlling the elevation adjustment mechanism and said actuator, or between controlling other aspects of the patient support apparatus. The control may include one or more accelerometers that sense movement of the portion of the person's body.

In some embodiments, the control may be positioned on the patient support apparatus, such as, for example, on either the frame or the head section, such that the control moves with the frame or the head section when they move. In one embodiment, the control is positioned on the head section and pressing upward on the control causes the head section to pivot upward, while pressing downward on the control causes the head section to pivot downward. In another embodiment, the control is positioned on the frame and pressing the control upward causes the frame to move upward while pressing the control downward causes the frame to move downward.

The portion of the person's body that moves in a particular direction may be the persons' finger and the control may be adapted to detect a force exerted by the person's finger against the control in the particular direction. The control may also control a speed of the component that is being moved as a result of the movement of the portion of the person's body. Such speed control may be based upon the speed of the movement of the portion of the person's body.

In some embodiments, the control may be positioned off of the patient support apparatus and further adapted to control an additional feature of the patient support apparatus. Such additional features may include any one or more of the following: zeroing a scale on the patient support apparatus, arming or disarming a bed exit detection system, moving a knee section of the patient support surface, turning on or off a monitoring system on the patient support apparatus, moving a siderail on the patient support apparatus up or down, locking out motion of a movable component of the patient support apparatus, locking out another control on the patient support apparatus, and controlling a motor adapted to move the patient support apparatus across a floor.

The control may additionally or alternatively be used to control a non-patient support apparatus feature. Such non-patient support apparatus features may include any one or more of the following: controlling a television, controlling a light, controlling a thermostat, or controlling a window covering.

The control may also be incorporated into any one or more of a watch, a personal digital assistant (PDA), a pendant or pedestal that is attachable and detachable to the patient support apparatus, a smart phone, or a fixed station positioned within the same room as the patient support apparatus.

The control may also include a camera that visually detects movement of the portion of the patient's body.

According to another embodiment, a patient support apparatus is provided that includes a base, a frame position above the base, a patient support surface, a control, and a controller. The patient support surface is supported on the frame and is moveable with respect to the base. The control is adapted to generate a first signal based upon a first force applied to the control in a first direction, and to generate a second signal based upon a second force applied to the control in a second direction opposite the first direction. The controller communicates with the control causes movement of the patient support surface in the first direction in response to the first signal and movement of the patient support surface in the second direction in response to the second signal.

According to other aspects, the control may include one or more load cells which, in some embodiments, are positioned on the siderail or head section of the patient support surface. The control may control upward and downward movement or pivoting of the entire patient support surface, or it may control upward and downward movement or pivoting of an individual section of the patient support surface.

According to another embodiment of the present invention, a patient support apparatus is provided that includes a base, a frame, an elevation adjustment mechanism, a patient support surface, an actuator, a control, and a controller. The frame is positioned above the base and the elevation adjustment mechanism is adapted to change an elevation of the frame with respect to the base. The patient support surface supports a patient and includes a head section that is pivotable about a generally horizontal pivot axis. The actuator is adapted to pivot the head section about the generally horizontal pivot axis. The control generates a control signal based upon movement of a portion of a person's body in one or more particular directions. The controller communicates with the control and is adapted to control at least one of the elevation mechanism and the actuator such that at least one of the head section and the frame moves in the same direction as the movement of the person's body part.

In other aspects, the patient support may further include a base having a plurality of wheels that allow the patient support apparatus to roll on a floor, and an elevation mechanism coupled to the base and the frame that allows a height of the frame with respect to the base to be adjusted. The patient support may also include a brake adapted to selectively lock and unlock at least one of the wheels; a bed exit system adapted to detect when a patient may exit the patient support apparatus; and a control panel adapted to allow a user to turn the bed exit system on and off. The patient support surface may include a head section that is pivotable about a generally horizontal pivot axis.

The aspect of the patient support apparatus that is controlled by the controller may be movement of a component of the patient support apparatus. The movement may be one or more of a height of the frame, a pivoting of the orientation of the frame, and/or a pivoting of a portion of the patient support surface.

The control may include an accelerometer and the control may adapted to be worn by a person, such as on a person's wrist, or in other locations.

The controller may be set to a first state in which it controls the patient support based upon the control signal, and a second state in which it effectively ignores the control signal. A switch may be included that switches the controller between the first and second states. Such switching may be based at least partially upon a detected proximity of a person to the patient support apparatus. The proximity may be determined by an RF ID tag worn by the person, or by other means. In other embodiments, the switching between the first and second states may be based on a physical switch that may be activated by a caregiver, or it may be based upon a voice-activated switch that is controlled by aural instructions. Regardless of the actual manifestation of the switch, a security structure may be included that is adapted to prevent unauthorized individuals from switching the controller between the first and second states.

In other aspects, a communications gateway may be included on the patient support apparatus that is adapted to transmit electronic signals from the patient support apparatus to another device. The aspect of the patient support apparatus that is controlled by the controller may be the transmission of an electronic signal from the communications gateway to the other device. The other device may be a room light controller, a thermostat, a television, a window covering controller, and/or a nurses' station.

The controller may move a component of the patient support apparatus in a common direction with the movement of the portion of the person's body. The person may be a patient or a caregiver.

The aspect of the patient support apparatus that is controlled by the controller based on the control signal may include any one or more of the following: a scale system integrated into the patient support apparatus; a bed exit alarm system integrated into the patient support apparatus; and a patient support apparatus monitoring system that issues an alert if a monitored condition changes to an undesired state. The controller may communicate informational updates to a personal device carried by a caregiver, wherein the informational updates include information related to the aspect of the patient support apparatus that is controlled by the controller. The personal device may be a smart phone, a pager, or a computer tablet.

According to yet another embodiment of the present invention, a patient support apparatus is provided that includes a base, a frame, a patient support surface, a plurality of load cells, an actuator, and a controller. The patient support apparatus is supported on the frame and adapted to support a patient. The load cells detect forces exerted by a patient positioned on the patient support surface. The actuator is adapted to physically move at least one component of the patient support apparatus when actuated. The controller communicates with the plurality of load cells and the actuator, and it is adapted to actuate the actuator in response to the forces detected by the plurality of load cells.

In other aspects, the patient support apparatus may include a pivotable head section that is pivotable by the actuator wherein the controller pivots the head section based upon forces detected by the plurality of load cells. Alternatively, or additionally, an actuator may be provided that raises or lowers a height of the frame relative to the base, and the controller may be adapted to change the height of the frame relative to the base based upon the forces detected by the plurality of load cells. The load cells may also be used to determine a patient's weight while positioned on the patient support surface.

The controller may follow suitable algorithms to analyze the forces detected by the plurality of load cells and distinguish between forces applied by a patient and forces applied by a caregiver, wherein the controller ignores those forces applied by the patient that are indicative of normal patient movement. In one possible algorithm, the forces sensed on a first side of the patient support are compared to the forces sensed on a second side of the patient support. If the forces on one side exceed those on the other side by more than a first threshold, the controller actuates the actuator. The controller may also be configured to measure the amount of time that the forces on one side exceed the forces on the other side and not activate the actuator if the amount of time does not exceed a predetermined threshold.

In some embodiments, the controller analyzes the forces detected by the plurality of load cells and actuates the actuator if the controller determines that a patient positioned on the patient support surface may be about to exit the bed. In such embodiments, the controller can also cause the actuator to lower the height of the frame if it determines that a patient positioned on the patient support surface may be about to exit the bed.

In other embodiments, an additional load cell or other type of force or contact sensor is positioned on the support apparatus and adapted to change a height of the frame relative to the base when sufficient force is applied to the additional load cell. In addition, or alternatively, the controller changes an orientation of at least one section of the patient support surface when sufficient force is applied to the additional load cell. Still further, the additional load cell may be used to control a gatch section of the patient support apparatus, or to control one or more side rails on the support apparatus, or to control a powered wheel on the support apparatus, or to control one or more lockouts on the patient support apparatus that selectively prevent the patient from controlling one or more features of the patient support apparatus.

In any of the embodiments described herein, the patient support apparatus may be a bed, a stretcher, a cot, a recliner, a chair, an operating table, or an examination table.

In yet another embodiment, a patient support apparatus is provided that includes a base, a frame, a patient support surface, an elevation adjustment mechanism, an actuator, a sensor, and a controller. The frame is positioned above the base. The elevation adjustment mechanism changes an elevation of the frame with respect to the base. The patient support surface is supported on the frame and provides support for a patient. The patient support surface includes a head section that is pivotable about a generally horizontal pivot axis. The actuator pivots the head section about the generally horizontal pivot axis. The sensor generates a control signal based upon a force applied to the sensor in a particular direction. The controller communicates with the sensor and controls at least one of the elevation mechanism and the actuator such that at least one of the head section and the frame moves in the particular direction when the force is applied to the sensor.

In some embodiments, the sensor is a load cell, and the load cell is positioned on a siderail or on the head section. In some embodiments, multiple load cells are used. And in still other embodiments, multiple load cells are used on both the siderails and the head section. Other locations of the patient support apparatus may also include load cells.

In still another embodiment, a patient support apparatus is provided that includes a base, a frame, a patient support surface, an actuator, a scale system, and a controller. The frame is positioned above the base, and the patient support surface is supported on the frame. The patient support surface is adapted to support a patient. The actuator physically moves a component of the patient support apparatus when actuated. The scale system includes a plurality of force sensors, and it is adapted to discriminate between first force components exerted on the plurality of force sensors that are indicative of a patient's weight and second force components exerted on the plurality of force sensors that are indicative of a desired movement of the component. The controller is in communication with the scale system and is adapted to actuate the actuator in response to the second force components detected by the plurality of force sensors.

The component may be a head section of the patient support apparatus wherein the actuator is adapted to pivot the head section about a generally horizontal pivot axis, or the component may be the frame wherein the actuator is adapted to change a height of the frame with respect to the base, or the component may be another movable part of the patient support apparatus.

Before the embodiments of the invention are explained in greater detail, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE EMBODIMENTS

Figure 1:
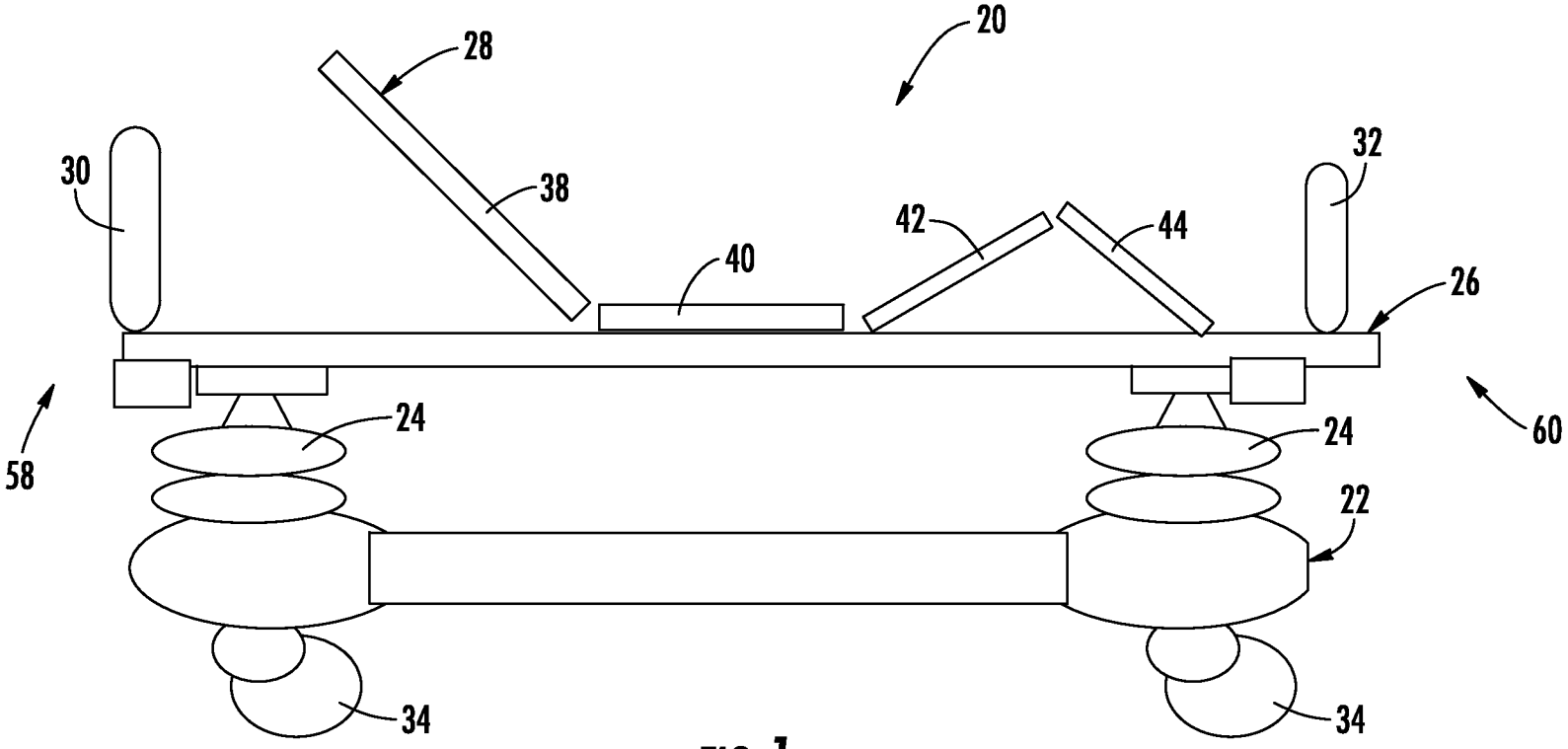
FIG. 1 is a side, elevational diagram of an illustrative patient support apparatus that incorporates one or more aspects of the present invention.

A patient support apparatus 20 according to one aspect of the present invention is shown in FIG. 1. While patient support apparatus 20 is, in the embodiment shown in FIG. 1, a bed useful for supporting a patient in a healthcare setting, it will be understood by those skilled in the art that patient support apparatus 20 can take on other forms. That is, patient support apparatus 20 may be a stretcher, a cot, a recliner, an operating table, or any other type of apparatus that is capable of supporting a patient thereon in a healthcare setting.

As shown in FIG. 1, patient support apparatus 20 includes a base 22, a pair of elevation adjustment mechanisms 24, a frame 26, a patient support deck 28, a headboard 30, and a footboard 32. Base 22 may include a plurality of wheels 34 that can be selectively locked and unlocked so that, when unlocked, patient support apparatus 20 may be wheeled to different locations. Elevation adjustment mechanisms 24 are adapted to raise and lower frame 26 with respect to base 22. Elevation adjustment mechanisms 24 may be hydraulic actuators, electric actuators, or any other suitable device for raising and lowering frame 26 with respect to base 22. In some embodiments, elevation adjustment mechanisms 24 may be operable independently so that the orientation of frame 26 with respect to base 22 may also be adjusted.

Frame 26 provides a structure for supporting patient support deck 28, headboard 30, and footboard 32. Patient support deck 28 is adapted to provide a surface on which a mattress 36 (FIG. 2), or other soft cushion may be positioned so that a patient may lie and/or sit thereon. Patient support deck 28 is made of a plurality of sections, some of which are pivotable about generally horizontal pivot axes. In the embodiment shown in FIG. 1, patient support deck 28 includes a head section 38, a seat section 40, a thigh section 42, and a foot section 44. Head section 38, which is also sometimes referred to as a Fowler section, is pivotable between a generally horizontal orientation (not shown in FIG. 1) and a plurality of raised positions (one of which is shown in FIG. 1). Thigh section 42 and foot section 44 may also be pivotable, such as is shown in FIG. 1.

Figure 2:
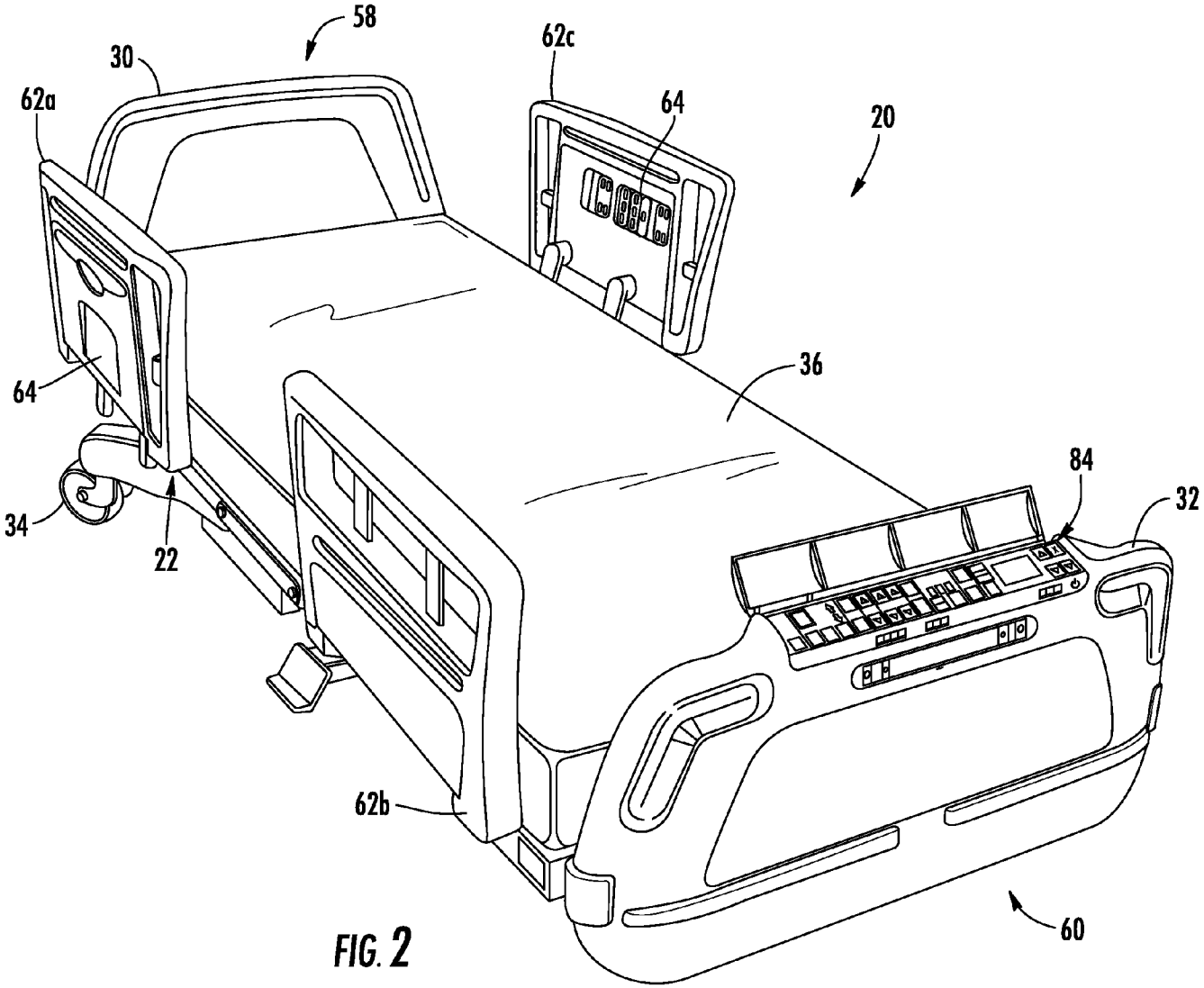
FIG. 2 is a perspective view of a different illustrative patient support apparatus that incorporates one or more aspects of the present invention shown with a patient support deck in a generally horizontal orientation.
Figure 3:
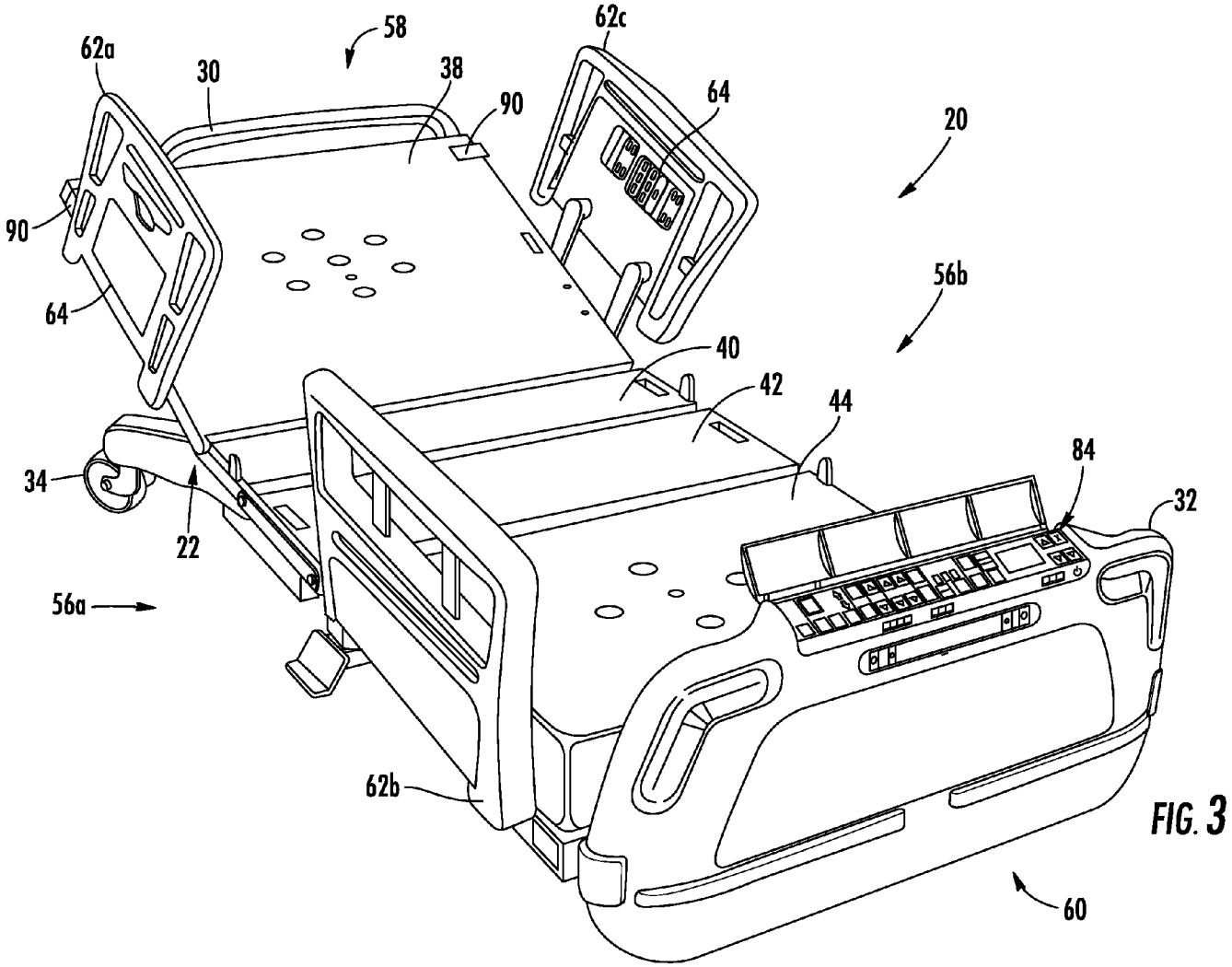
FIG. 3 is a perspective view of the patient support apparatus of FIG. 2 shown with a mattress removed and a head section of a patient support deck pivoted upwardly.
Figure 4:
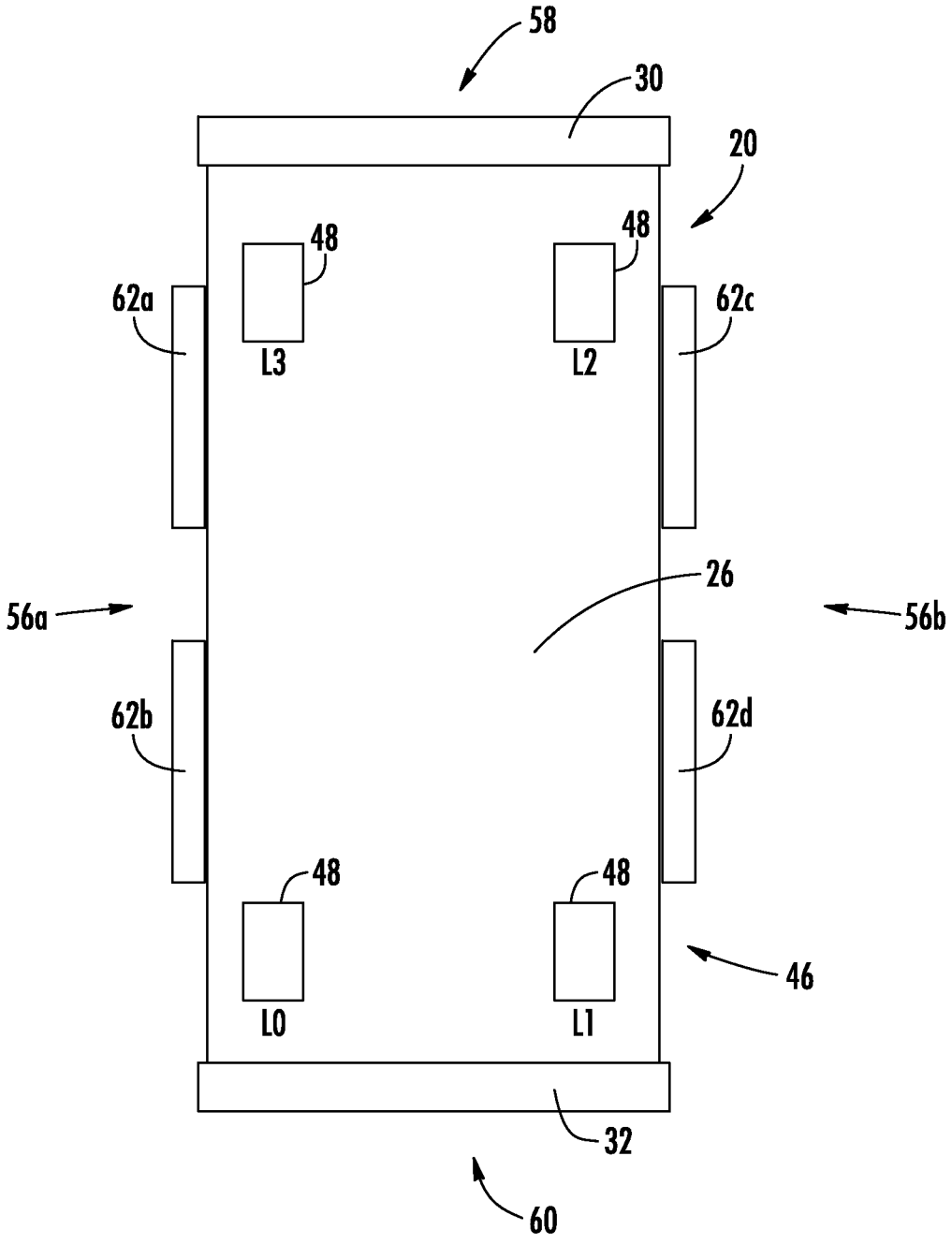
FIG. 4 is a plan view diagram of a plurality of load cells that may be used in a patient support apparatus incorporating one or more aspects of the present invention.

A plurality of siderails 62 are also be coupled to frame 26. In the embodiment of FIGS. 2-3, the patient support apparatus 20 includes four siderails: a right head siderail 62*a*, a right foot siderail 62*b*, a left head siderail 62*c* and a left foot siderail 62*d* (FIG. 4). Siderails 62 are be movable between a raised position and a lowered position. In the configurations shown in FIGS. 2 and 3, right head siderail 62*a*, right foot siderail 62*b*, and left head siderail 62*c* are shown in the raised position, while left foot siderail 62*d* (not visible) has been moved to the lowered position.

The construction of any of base 22, elevation adjustment mechanisms 24, frame 26, patient support deck 28, headboard 30, footboard 32, and/or siderails 62 may be the same as disclosed in commonly assigned, U.S. Pat. No. 7,690,059 issued to Lemire et al., and entitled HOSPITAL BED, the complete disclosure of which is incorporated herein by reference; or as disclosed in commonly assigned U.S. Pat. publication No. 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosure of which is also hereby incorporated herein by reference. The construction of any of base 22, elevation adjustment mechanisms 24, frame 26, patient support deck 28, headboard 30, footboard 32 and/or siderails 62 may also take on forms different from what is disclosed in the aforementioned patent and patent publication.

In one embodiment, patient support apparatus 20 includes a bed exit detection system 46 (FIG. 4) incorporated therein that includes a plurality of load cells 48. The load cells 48 are positioned on the frame in locations such that the weight of a patient can be determined from the combined readings of a plurality of the load cells. In one arrangement, the load cells are positioned such that one load cell 48 is positioned adjacent each corner of a load frame (not shown), and the load cells 48 detect forces exerted by a patient support frame upon the load frame (through the load cells). While the construction of the load frame and patient support frame may vary, one example is disclosed in the commonly assigned U.S. Pat. No. 7,690,059 mentioned above and incorporated herein by reference. Other constructions of the frames and positions of the load cells may also be used.

FIG. 4 shows a plan view diagram of an illustrative layout of load cells 48. A first load cell labeled L3 is positioned adjacent a head end 58 of patient support apparatus 20 on a first side 56*a*. A second load cell L0 is also positioned on first side 56*a*, but positioned near a foot end 60 of patient support apparatus 20. Third and fourth load cells L2 and L1 are positioned on a second side 56*b* adjacent the head end and foot ends 58 and 60, respectively. As was noted above, load cells 48 are positioned to sense the forces exerted by a load frame portion of frame 26 onto an intermediate frame portion of frame 26. Such forces may be exerted by the weight of a patient positioned on patient support deck 28, by objects placed on mattress 36, or by other people or objects.

In some embodiments, the load cells 48 are used to detect whether a patient has exited patient support apparatus 20, or is about to exit patient support 20. One manner in which the load cells may be used to determine patient exit, or potential patient exit, is disclosed in commonly assigned, U.S. Pat. No. 5,276,432 issued to Travis and entitled PATIENT EXIT DETECTION MECHANISM FOR HOSPITAL BED, the complete disclosure of which is also hereby incorporated herein by reference. Other methods for using the load cells to determine patient bed exit may also be used. In the method disclosed in the U.S. Pat. No. 5,276,432 patent, the force sensed by each load cell is determined and used, in combination with the location of each load cell, to determine the center of gravity of the forces exerted on the load cells. If the center of gravity of the forces is within a predefined region, no patient exit is presumed. If the center of gravity moves outside of a predefined region, a patient exit may be assumed, and an alarm may issue on patient support apparatus 20, and/or at a remote location in communication with patient support apparatus 20, such as a nurses' station. In some embodiments, there may be multiple predefined regions, and a caregiver may be able to select which region will cause a patient exit alert to issue.

In addition to determining whether a patient has exited the patient support apparatus 20, or may be about to exit the patient support apparatus 20, the load cells 48 are used to determine a weight of a patient positioned on patient support apparatus 20. Such weight measurements are based upon a summation of the total forces sensed by the load cells 48, minus the weight of the non-patient objects that exert a force on the load cells.

According to one embodiment of the present invention, one or more force sensors, such as load cells 48, are used for controlling the movement of one or more aspects of patient support apparatus 20. Such use of the load cells may be in addition to using the load cells for determining patient weight and/or bed exit alerts, or such use may, in some embodiments, be exclusively for controlling movement of one or more components of patient support apparatus 20. Still further, in some embodiments, existing patient support apparatuses having load cells incorporated therein may be retrofitted in accordance with the teachings of the present invention to allow the load cells to be used for controlling patient support apparatus movement. In other words, an existing prior art patient support apparatus having a scale system for determining a patient weight (which may include a plurality of load cells) may be retrofitted to include different software and/or different controllers that process the outputs of the scale system to distinguish between forces due to patient weight and forces due to a caregiver wishing to change a position or orientation of a component on the patient support apparatus.

Figure 5:
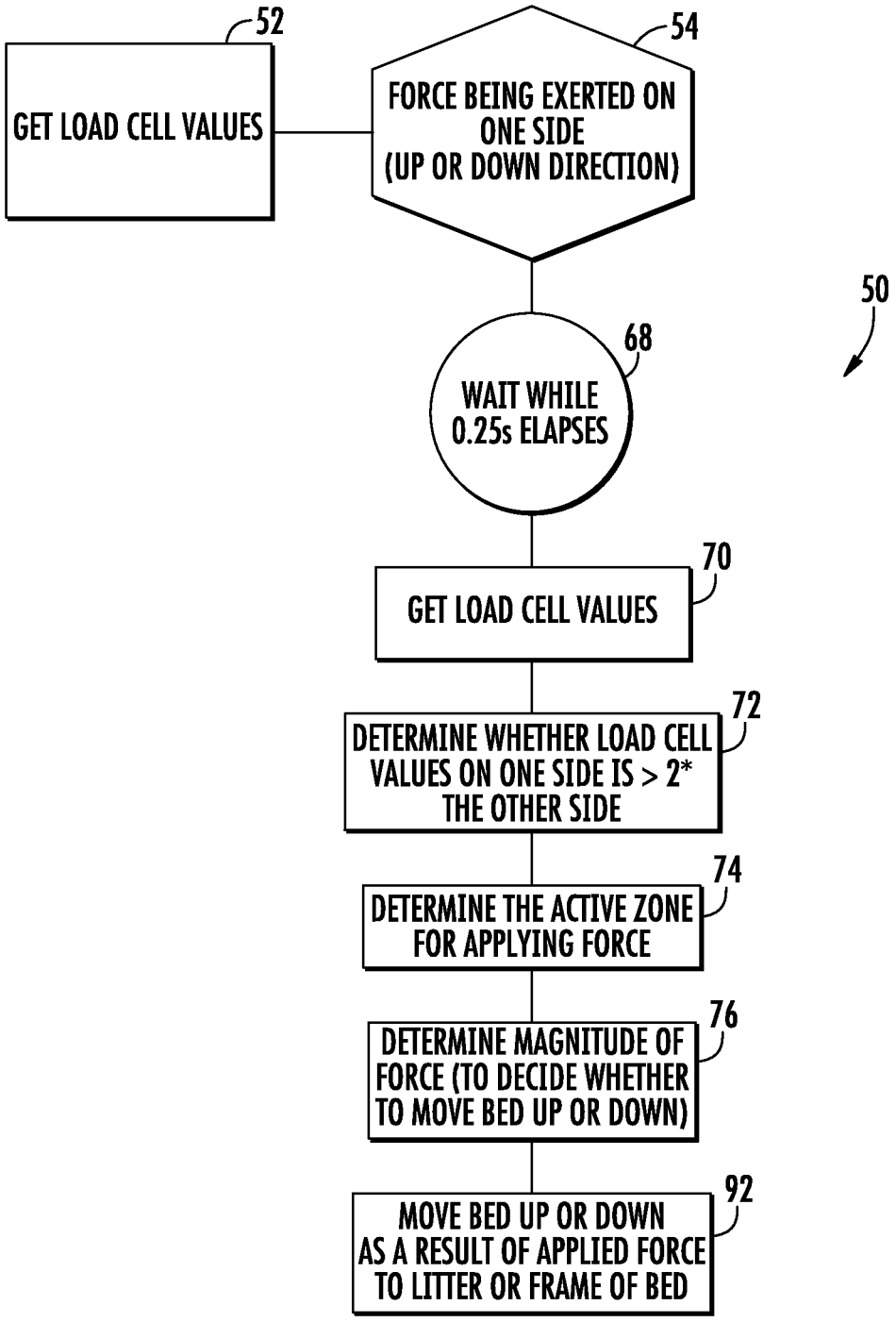
FIG. 5 is a flow chart of an illustrative algorithm that may be used for controlling a height of a patient support apparatus according to one aspect of the invention.

FIG. 5 illustrates an illustrative height control algorithm 50 for controlling a height of frame 26 relative to base 22 using one or more of the load cells 48. Height control algorithm 50 may be modified in a variety of different manners and should be understood to represent only one of many different algorithms that may be used to control the height of the patient support frame 26. In general, height control algorithm 50 is designed to activate the elevation adjustment mechanisms 24 based upon a caregiver, or other user who is not positioned on patient support apparatus 20, exerting a lifting force or a downward force on some portion of the support frame 26, or on a component coupled to the support frame 26. Thus, height control algorithm 50 allows a user to raise or lower patient support apparatus 20 without having to push one of the dedicated control buttons, or other types of controls, that are commonly found on one or more of the control panels on a patient support apparatus. Instead, the user can push down anywhere on footboard 32, for example, or any of the multiple siderails 62, in order to cause a controller of the patient support apparatus 20 to activate elevation adjustment mechanisms and change the height of frame 26 in the direction of the exerted force. Forces may also be applied to other locations to cause the height of the bed to change automatically.

Control algorithm 50 therefore gives a caregiver greater freedom and ease for making adjustments to the height of the bed, or other type of patient support apparatus 20. If the caregiver is positioned near the head end 58 of the patient support apparatus 20, a siderail control panel 64 may not be easily reachable by the caregiver, due to the siderail being moved to its lowered position, or due to the caregiver being in a location that makes it difficult to reach the siderail control panel. Therefore, instead of having to press the appropriate button on the siderail control panel 64 to lower the patient support apparatus 20, for example, he or she can simply push down on any portion of the siderail, or on the edge of the mattress 36 nearest him or her. In either case, this downward force will be sensed by the load cells, and algorithm 50 will cause the height of the patient support apparatus to automatically be lowered. The details of one version of height control algorithm 50 are described below.

Figure 6:
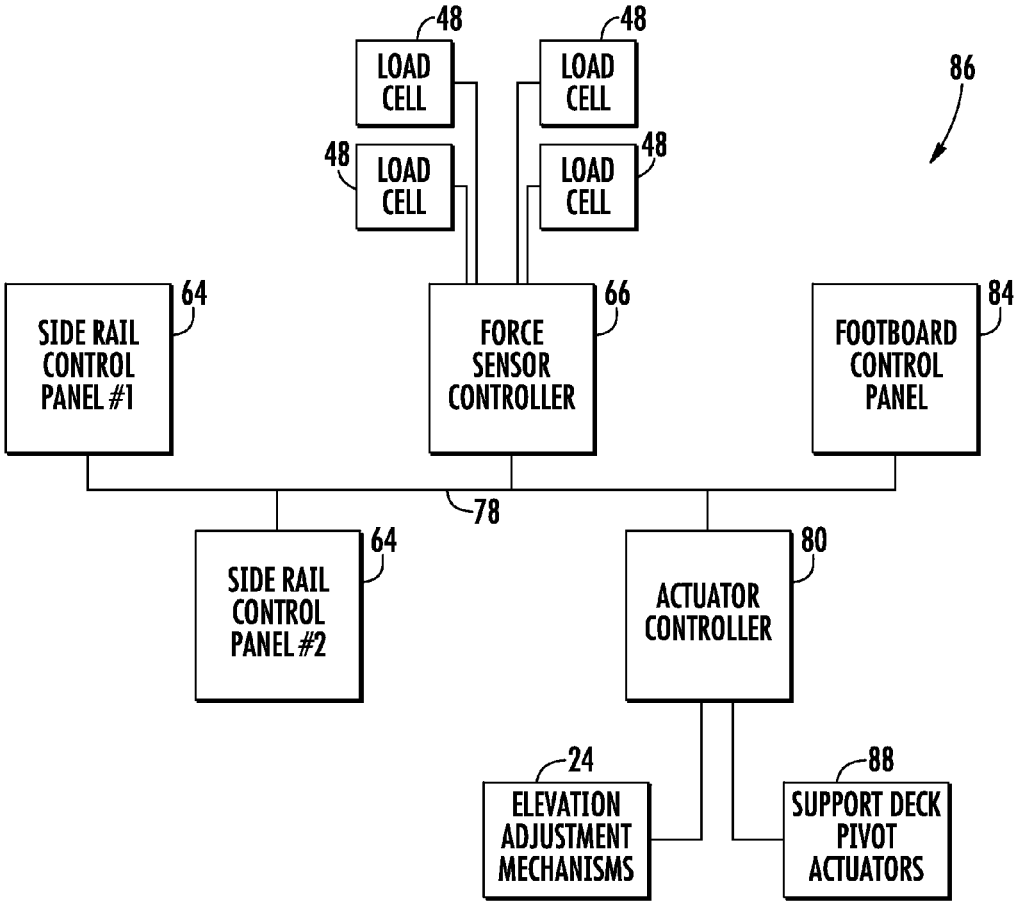
FIG. 6 is a diagram illustrating an electronic control system for a patient support apparatus according to one embodiment of the present invention.

Height control algorithm 50 is carried out by a force sensor controller 66 that is positioned on patient support apparatus 20 (FIG. 6). Any suitable processor, or other electronic circuitry capable of performing the steps of algorithm 50, may be included within force sensor controller 66. At an initial step 52, the readings from the load cells 48 are taken. These readings are taken after any patient weight, or other weight from objects positioned on the patient support apparatus 20, have been zeroed out. That is, the readings from the load cells 48 are adjusted to remove any force components that are due to a patient or other objects on apparatus 20. If there are four load cells, such as load cells L0, L1, L2, and L3 in FIG. 4, then readings are taken of the forces sensed by each load cell 48 at step 52. Such readings are processed by a processor, or other electronic structures, that are part of force sensor controller 66 (FIG. 6), or that are part of another structure. The total value of the forces sensed by the load cells 48 is then summed and this sum is retained in a memory that is accessible to force sensor controller 66, or whatever other structure is carrying out algorithm 50. (For purposes of the subsequent description, it will be assumed that controller 66 carries out algorithm 50, although, as noted, it will be understood by those skilled in the art that other structures could carry out algorithm 50).

At a subsequent step 54, controller 66 determines whether forces are being applied to one of first side 56*a* or second side 56*b*. In some embodiments, controller 66 may also or alternatively determine at step 54 whether force is being applied to one or both of head end 58 and/or foot end 60 as well. While step 54 is illustrated in FIG. 5 as determining whether any force is being applied, step 54 may actually determine if the sensed forces exceed a non-zero threshold. Such a non-zero threshold may be set to exclude detected forces that are too weak to likely be caused by a caregiver, or which are determined by design to be too weak to cause any physical actuation of patient support apparatus 20. The precise amount of any such threshold can vary as desired. In some embodiments, it may be in the range of one to several pounds, although other forces outside this range can also be used. Indeed, in one embodiment, step 54 acts upon any non-zero forces.

If the forces detected at step 54 exceed the threshold (whether zero or non-zero), then controller 66 proceeds to a wait step 68. (If the forces do not exceed the threshold, control returns to step 52). At step 68, controller 66 waits for a predetermined threshold amount of time before proceeding to step 70. While the predetermined threshold time that is shown in FIG. 5 is one quarter of a second, it will be understood by those skilled in the art that this amount of time can be varied. Generally speaking, the predetermined amount of time used in step 68 serves the purpose of excluding transient forces that may be applied to load cells 48 without the intent of causing the height of patient support apparatus 20 to be changed. Such forces may be due to a caregiver bumping into a siderail, or the patient temporarily shifting position while on the patient support apparatus 20, or other causes.

Once the time period of step 68 has passed, controller 66 moves onto step 70 where fresh readings from the load cells 48 are again taken by controller 66. These readings are taken with the same zeroing adjustments that may have been applied prior to step 52. That is, no further zeroing adjustments are made between the time of step 52 and step 70. If the readings taken at step 70 are zero, then control returns back to initial step 52. If the readings taken at step 70 are non-zero, then control passes onto a comparison step 72. At comparison step 72, controller 66 determines whether the forces detected on one side of apparatus 20 exceed a threshold ratio with respect to the forces detected on the opposite side of apparatus 20. In the embodiment illustrated, the threshold ratio is two, although it will be understood that other ratios may be used.

The purpose of step 72 is to eliminate, or reduce occurrences, where patient support apparatus 20 changes the height of frame 26 based upon longer-lasting forces that are not intended to cause a change in the height of frame 26. Such longer-lasting forces could be due to an object being placed on patient support deck 28, or for other reasons. Generally speaking, an object placed on patient support deck 28 will have its weight positively distributed in some fashion amongst the plurality of load cells 48. This is because the object will typically be placed somewhere between the load cells, rather than at the very edge, or outside of the edge, of the perimeter defined by the load cells. In contrast, if a caregiver pushes on siderails 62, or on an edge of mattress 36 or frame 26, such forces will be centered outside of the perimeter defined by load cells 48. As a result, any upward or downward forces exerted on siderails 62 will tend to have a positive impact on the load cells 48 on one of sides 56*a* and *b*, and a negative impact on the load cells 48 on the other of sides 56*a* and *b*. This can be seen more clearly using an example referencing FIG. 4.

Suppose, for example, that a downward force is applied to right head siderail 62*a* by a caregiver who wishes to lower the height of frame 26 with respect to base 22. This downward force will be sensed primarily by load cell L3, which is positioned closest to siderail 62*a*. Load cell L0, which is also on right side 56*a* of apparatus 20 will also likely experience a positive force, although its magnitude will be diminished in comparison to the positive force exerted on load cell L3 due to its greater distance away from siderail 62*a*. Load cells L2 and L1, in contrast, will likely experience a negative force (i.e. an upward force). This is because the structure of the load frame and the intermediate frame create a fulcrum such that a downward (positive) force applied to one side of the patient support apparatus cause at least some lifting (negative) force to be sensed by the load cells on the opposite side. A downward force applied to head siderail 62*a* may therefore increase the force sensed by load cell L3 by, say, four pounds, while decreasing the force sensed by load cell L2 by potentially several pounds. Comparison step 72 therefore checks for load imbalances meeting a defined ratio to detect whether loads are being applied to the edge regions of patient support apparatus 20, which are indicative of an intent to change the height of frame 26.

If the force ratio threshold of step 72 is met, controller 66 proceeds to step 74 where it determines if the force detected by load cells 48 is being applied in a designated area or active zone. Step 74 is an optional step that may be implemented if it is desired to only allow forces to be applied in certain areas on patient support apparatus 20. For example, in one embodiment, height control algorithm 50 is configured so that only force applied to support apparatus 20 in the area of the head end siderails 62*a* and 62*c* will cause the frame height to change. Alternatively, in another embodiment, height control algorithm 50 is configured so that only force applied to support apparatus 20 in the area of the foot end siderails 62*b* and 62*d* will cause the frame height to change. Or, as still another alternative, height control algorithm 50 could be configured so that only force applied to support apparatus 20 in the area of either or both of the footboard 32 or the headboard 30 will cause the frame height to change. Any combination and/or permutation of these areas, or other areas, could also be defined as active zones.

Controller 66 determines if the applied forces are being applied in the active zone by analyzing the force components detected by the four load cells 48. This may be done in a variety of different ways. In one manner, controller 66 analyzes the forces detected at step 70 and determining a center of gravity of the forces, such as in the manner disclosed in the above-referenced U.S. Pat. No. 5,276,432 patent, which is incorporated herein by reference. If the center of gravity falls within an active zone, the controller 66 proceeds to step 76. If it does not, then controller 66 returns to step 52. In other embodiments, controller 66 need not determine the center of gravity in both X (side-to-side) and Y (head end to foot end) dimensions. Depending upon how the active zones are defined, the center of gravity in only a single dimension X or Y could be determined. In still other embodiments, a center of gravity need not be determined at all. Instead, controller 66 could determine if a force was applied in an active zone by determining whether certain predefined force amounts and/or ratios were met.

At step 76, controller 66 determines the direction of the forces sensed in the active zone. If the forces are positive, then this indicates an intent to lower the height of frame 26. If the forces are negative, then this indicates an intent to raise the height of frame 26. Once the direction of the force is determined at step 76, control proceeds to step 92, where controller 66 either moves frame 26 in the appropriate direction, or it issues a command to another component to move the frame in the desired direction. In an electronic control system, such as electronic control system 86 of FIG. 6, force sensor controller 66 issue a command for lowering or raising frame 26 to a communications network 78 on patient support apparatus 20. Communications network 78 could be Controller Area Network, a LONWorks network, a Local Interconnect Network (LIN), a FireWire network, or any other known network for communicating messages between electronic structures on patient support apparatus. In the embodiment of FIG. 6, the command issued by force sensor controller 66 is received by an actuator controller 80 that controls the movement of elevation adjustment mechanisms 24. Actuator controller 80 activates elevation adjustment mechanisms 24 to cause them to raise or lower frame 26, as commanded by force sensor controller 66. A command to stop the raising or lowering of frame 26 is issued by controller 66 when the specific forces detected by load cells 48 are no longer detected. The raising or lowering of frame 26 is carried out by activating each elevation adjustment mechanism 24 in the same direction and by the same amount so that the orientation of frame 26 relative to base 22 does not change during the change in elevation.

It will be understood by those skilled in the art that variations can be made to height control algorithm. As one potential variation, the command to raise or lower the frame 26 could be structured to individually control the two elevation adjustment mechanisms in different manners, creating the possibility of pivoting the frame 26 with respect to base 22. That is, one of the elevation adjustment mechanisms 24 could move upward or downward a different amount, or at a different rate, than the other elevation adjustment mechanism 24, resulting in a change in the orientation of frame 26. The individual control of the elevation adjustment mechanisms 24 could be based upon the distribution amongst the four load cells 48 of the force applied, or it could be based upon a caregiver-accessible switch that enables the caregiver to select between pivoting and non-pivoting movement of frame 26, or it could be based upon other factors.

It will also be understood that another modification to height control algorithm 50 could be to analyze the forces applied at or near an end of patient support apparatus 20, rather than, or in addition to, the forces exerted at or near the sides. For example, step 72 could be modified to compare the forces exerted on the load cells 48 adjacent head end 58 (L2 and L3) with those load cells adjacent foot end 60 (L0 and L1). If the ratio of this comparison exceeded a predetermined threshold, then controller 66 could proceed to step 74 in the same manner discussed above. This modification would make is easier for a caregiver to control the height of the frame 26 by simply pressing upward or downward on either of footboard 32 or headboard 30. Such forces would be detected by load cells 48, and processed by controller 66 in a manner that caused it to issue a raise or lower command to controller 80.

In any of the embodiments discussed herein, height control algorithm 50 may be configured such that it can be turned on or off. When turned off, forces exerted onto the load cells 48 of patient support apparatus 20 are not processed by controller 66 in the manner described above, but instead are ignored (at least with respect to controlling the movement of some portion of the patient support apparatus 20—such forces may still affect weight calculations and/or bed exit detection algorithms). When turned on, then the steps of algorithm 50 are followed by controller 66.

In some embodiments, the switch to turn on and off height control algorithm 50 is positioned at one or more locations on patient support apparatus 20, such as, but no limited to, at one or both of a pair of siderail control panels 64*a* and/or b, a footboard control panel 84, at a non-control panel location on patient support apparatus 20, or at a location remote from patient support apparatus wherein the switch status was communicated to patient support apparatus 20. In one embodiment, caregivers wear RF ID tags, or other devices, that wirelessly communicate with structures so that the location of the caregiver can be determined, and the RF ID tags, or other devices, are used to automatically activate height control algorithm 50 when a caregiver is positioned within a vicinity of patient support apparatus 20. Thus, in one embodiment, patient support apparatus 20 includes wireless circuitry built into it that communicates with the RF ID tags, or other tags, worn by the caregivers. Such communication enables patient support apparatus 20 to know when a caregiver is positioned within the vicinity of patient support apparatus 20. When so positioned, patient support apparatus 20 is configured to automatically turn on height control algorithm 50. Further, when the caregiver leaves the vicinity of patient support apparatus 20—as detected by the RF ID tag communication circuitry—patient support apparatus 20 is configured to automatically shut off height control algorithm 50.

Alternatively, the RF ID tags could communicate with a centralized server or other component of a healthcare computer network, which then forwards the current location of the caregiver to patient support apparatus 20. In such cases, the patient support apparatus 20 may include wireless or wired circuitry that couples patient support apparatus 20 to the healthcare facility computer network, or other structures that process the data received from the RF ID tags.

In one embodiment, the enablement and disablement of height control algorithm 50 is based upon the detection by patient support apparatus 20 of a near field communication device worn by the caregiver. The design of patient support apparatuses and wearable devices that communicate with each other via near field communications is disclosed in commonly assigned U.S. patent application Ser. No. 61/701,943 filed Sep. 27, 2012, by Applicants Michael Hayes et al. and entitled COMMUNICATION SYSTEMS FOR PATIENT SUPPORT APPARATUSES, the complete disclosure of which is hereby incorporated herein by reference. Because near field communication has only a short communication range, the fact that patient support apparatus 20 is able to communicate with a device worn by a user—such as a near field tag—is interpreted by patient support apparatus 20 to mean that the person is near patient support apparatus 20, and patient support apparatus 20 therefore automatically enables height control algorithm 50. When near field communication is no longer established, patient support apparatus 20 automatically disables height control algorithm 50. In this embodiment, therefore, the ability to control the movement of patient support apparatus 20 via height control algorithm 50 is limited to authorized personnel (wearing the appropriate tag, or other device) who are within the vicinity of patient support apparatus 20.

Having an automated turning on and turning off of height control algorithm 50 allows a caregiver to adjust the height of the patient support apparatus 20 by simply pushing or pulling on patient support apparatus without having to first manually manipulate any switches, buttons, dials, or other user controls. Further, after the caregiver leaves the vicinity of a patient support apparatus, the height of the patient support apparatus can no longer be adjusted based upon forces applied to frame 26. (Instead, the height can only be adjusted by using the conventional siderail or footboard control panels). This eliminates the possibility of inadvertent height adjustments being made based on visitors leaning on the patient support apparatus 20, or other situations in which a force was exerted on patient support apparatus 20 by a non-caregiver that was not intended to change the height of frame 26.

In still other embodiments, caregivers are equipped with remote controls that are built into electronic structures that are carried by the caregivers, such as cell phones, wristband mounted electronics, pagers, personal digital assistants, or other structures. Such controls include switches, buttons, or the like that enable a caregiver to turn on or off height control algorithm 50, or such controls automatically communicate wirelessly with patient support apparatus 20 while in the vicinity thereof to turn on height control algorithm 50.

In addition to switching height control algorithm 50 completely on or completely off, patient support apparatus 20 is configured, in at least one embodiment, so that different types of control algorithms, or different versions of control algorithm 50, can be chosen by one or more switches accessible to the caregiver. Thus, for example, instead of merely just turning control algorithm 50 on or off, a caregiver uses a switch—or other similar type of structure—to choose which of multiple different types of algorithms will be turned on or off. In one embodiment, the multiple algorithms include a first algorithm that raises or lowers elevation adjustment mechanisms 24 in a uniform manner based upon applied forces, and a second algorithm that raises or lowers elevation adjustment mechanisms 24 in a non-uniform manner based upon applied forces (thereby causing frame 26 to change orientation).

In another embodiment, such a switch is used to select between controlling the height of frame 26 and controlling the pivoting of one or more of the sections of patient support deck 28. That is, patient support apparatus 20 is configured such that, in one mode, exerting extraneous forces on frame 26 causes the height of frame 26 to change, and in another mode, exerting extraneous forces on frame 26 causes one or more of deck sections 38, 40, 42, or 44 to pivot. Such pivoting of these deck sections is controlled in a manner similar to height control algorithm 50. That is, force controller 66 examines the forces detected on load cells 48 and, depending upon the distribution of the forces amongst the load cells 48, as well as the magnitude, issues a command to actuator controller 80 that causes actuator controller 80 to activate one or more support deck pivot actuators 88. Support deck pivot actuators 88 may conventional linear actuators, motors, threaded drives, or any other structures capable of moving one or more of the sections of deck 28. Consequently, in one mode, a caregiver pushing down on a head end region of patient support apparatus 20 will, for example, cause the Fowler or head section 38 to pivot downward, while pulling up in the same region will cause the head section 38 to pivot upward. Such forces may be exerted on the siderails 62*a* or *c*, on the frame 26, or on the deck 28 itself. Similar situations may be configured for controlling the pivoting of the seat, thigh, or foot sections 40, 42, and 42, respectively, either individually or in combination.

Figure 7:
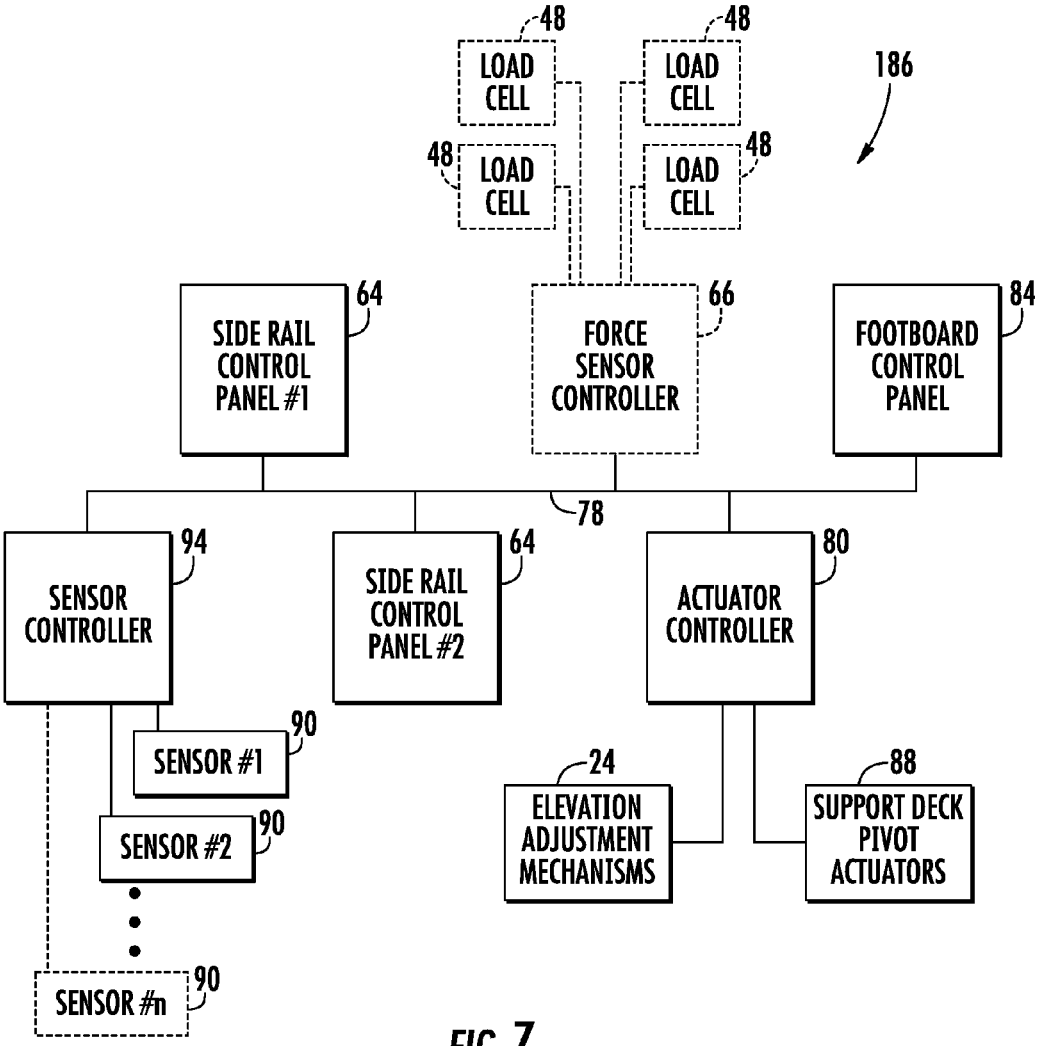
FIG. 7 is a diagram illustrating an electronic control system for a patient support apparatus according to another embodiment of the present invention.

FIG. 7 illustrates an electronic control system 186 according to another embodiment of the present invention. In the embodiment of FIG. 7, electronic control system 186 has been modified from the system 86 of FIG. 6 by the addition of a sensor controller 94 and a plurality of force sensors 90, as well as the rendering of force sensor controller 66 an optional component (signified by the dashed lines). That is, control system 186 may or may not include force sensor controller 66. Further, if control system 186 does include sensor controller 66, sensor controller 66 may or may not be used in controlling the movement of one or more components of patient support apparatus 20. That is, in some embodiments, control system 186 includes a force sensor controller 66 that only processes the outputs of load cells 48 for determining bed exit conditions and/or patient weight (i.e. controller 66 does not output any move commands to network 78). In other embodiments, control system 186 includes a force sensor controller 66 that does output move commands to network 78 in the manners described above, such as, but not limited to, outputting commands for raising or lowering the height of frame 26 with respect to base 22. In such embodiments of control system 186, force sensor controller 66 may or may not additionally process the outputs of load cells 48 for determining bed exit alerts and/or for determining patient weight. Still further, as will be described in greater detail below, control system 186 can be modified further to include a wireless receiver and controller.

Figure 9:
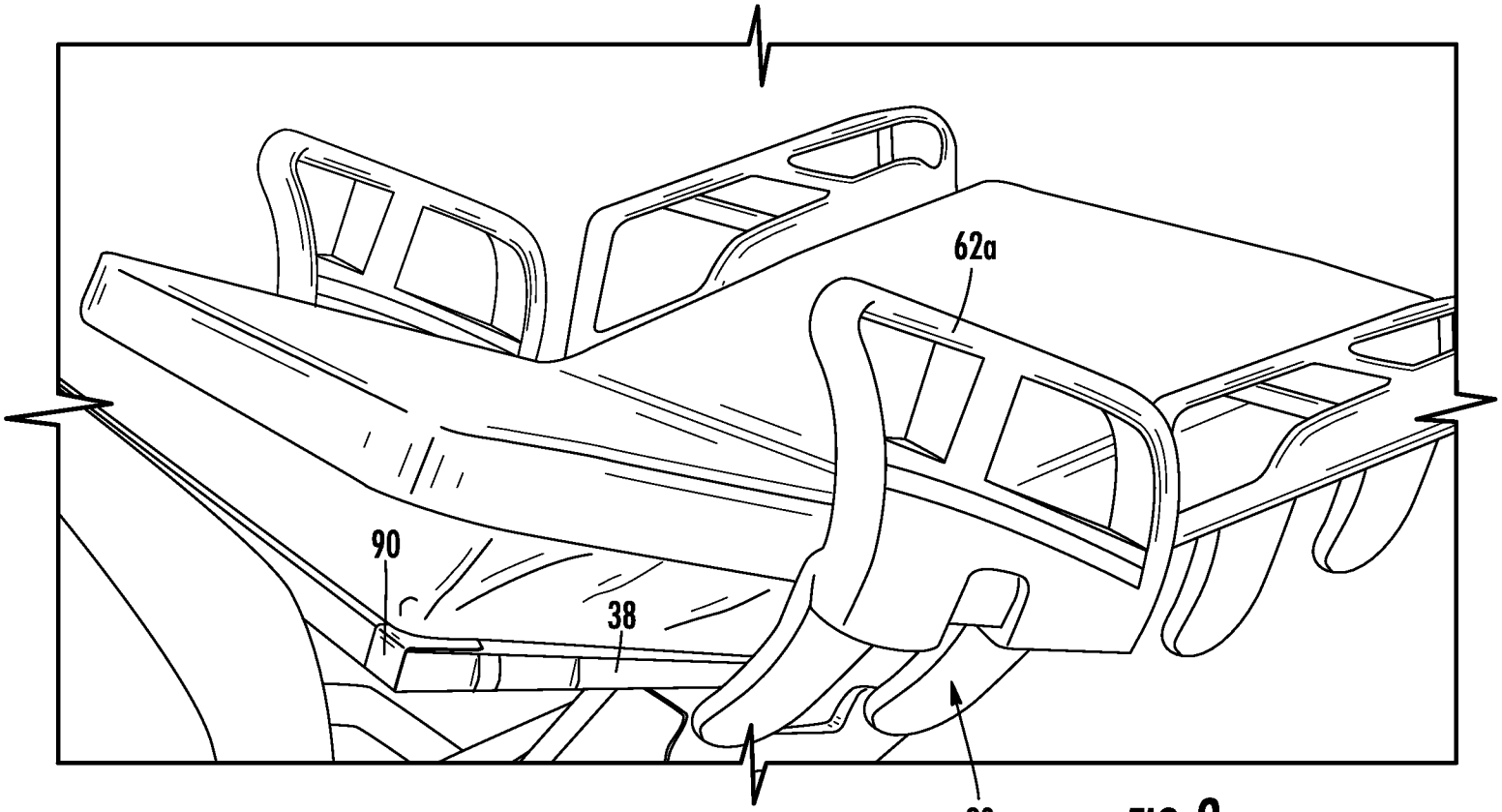
FIG. 9 is a perspective view of a patient support apparatus having a sensor or control mounted on a Fowler section of a patient support apparatus that may be used to control the pivoting of the Fowler section.

FIG. 9 illustrates another embodiment of a patient support apparatus 20 that includes electronic control system 186. The patient support apparatus 20 of FIG. 9 includes one or more force sensors 90 positioned in locations where forces would normally be applied by a caregiver to effect the desired movement if the patient support apparatus 20 were one that was entirely manually operated. In other words, the sensors 90 are positioned in locations that one would expect to manipulate if no actuators existed on the support apparatus 20 and one was forced to supply all of the force necessary to effect the desired movement. One illustrative example of this can be seen in FIG. 9 where a force sensor 90 is positioned near an upper corner of head section 38 of patient support deck 28. The location of force sensor 90 is positioned in an area that a caregiver would normally place his or her hand if they wanted to manually lift or lower head section 38. However, force sensor 90 is provided so that, when a user pushes up or down on it, head section 38 will automatically pivot upward or downward so that a user does not, in fact, have to supply the force necessary to pivot head section 38.

While not visible in the embodiment shown in FIG. 9, an additional force sensor 90 is positioned at a similar location near the opposite upper corner of head section 38 so that a caregiver positioned on the opposite side of patient support apparatus 20 can raise or lower head section 38 by pushing or pulling on the additional, adjacent force sensor 90. An example of such an additional force sensor 90 is shown in FIG. 3.

It will further be understood that force sensors 90 can be positioned in other locations on patient support apparatus 20. For example, a force sensor 90 may be positioned on any of the other pivotable sections of the patient support deck 28 so that forces exerted by a caregiver thereon cause the respective deck section to pivot upwardly or downwardly (depending on the direction of the exerted force). Still further, force sensors 90 can be positioned at non-deck locations on patient support apparatus such that forces exerted thereon cause other components of the patient support apparatus to move. As one example, force sensors 90 can be positioned at locations where pushing or pulling on them caused the entire frame 26 to move up or down. Such locations include positions on one or more of the siderails 62, or on sides of frame 26, at footboard 32, or at headboard 30.

The number and location of force sensors 90 can vary on any given patient support apparatus 20. Thus, in the example shown in FIG. 9, only two force sensors 90 are positioned on patient support apparatus 20—one at each head end corner of head section 38. However, in other embodiments, the sensors at the corners of head section 38 can be moved to other locations for controlling the movement of other components, or, alternatively, force sensors 90 could remain in the corners of head section 38 while additional force sensors 90 are added to patient support apparatus 20 at other locations for controlling other components of support apparatus 20. Still further, in some embodiments, multiple force sensors 90 are positioned at different locations for controlling the same component of patient support apparatus. For example, a force sensor 90 might be positioned on a siderail 62 for raising or lowering frame 26, while another force sensor that also raised and lowered frame 26 was positioned at some location directly on frame 26.

The size and shape of force sensors 90 can vary from that shown in FIGS. 9-12. For example, force sensors 90 could be modified from that shown in FIGS. 9-12 so that they were elongated and extended along a greater portion of the side and/or the head end of head section 38. Such greater size would enable a caregiver to push up or down in a greater number of locations on head section 38, thereby making it easier for the caregiver to raise or lower head section 38, or whatever other component is being controlled by the force sensor. In one embodiment, force sensors 90 may include load cells, although it will be understood that other types of force sensors could be used.

In operation, each force sensor 90 detects forces that are exerted against it and outputs a signal corresponding to the detected force to sensor controller 94 (FIG. 7). In some embodiments, the force sensor 90 only detects that a force has been applied, but not the direction or magnitude. In other embodiments, the force sensor 90 detects one or both of the direction and the magnitude of the applied force. In those cases where the direction of the force is not detected, the individual force sensor 90 is positioned such that forces applied thereto are inherently in a known direction. For example, where a first force sensor 90 is positioned on top of head section 38 while a second force sensor 90 is positioned underneath head section 38, the first force sensor 90 would not need to be able to detect the direction of the applied force because it would be assumed to be downward. Likewise, the second force sensor 90 would also not need to be able to detect the direction of the applied force because it would be assumed to be upward.

In the example shown in FIGS. 9-12, it should be noted that force sensor 90 is configured to wrap around an edge of head section 38 and includes both a top surface and a bottom surface. Pushing on the top surface will either compress or expand a load cell built into force sensor 90, while pushing on the bottom surface will do the opposite to the load cell. In this configuration, only a single load cell is used for sensing both upward and downward forces applied by a caregiver. When force sensors 90 are positioned elsewhere on patient support apparatus 20, it may be desirable to include two separate load cells—or other types of sensors—one of which detects upward forces and the other of which detects downward forces.

Regardless of whether or not force sensors 90 detect a specific magnitude of the applied force and/or a direction, the output of the force sensor 90 is forwarded to sensor controller 94 for processing. Sensor controller 94, as with any of the controllers discussed herein, includes one or more microprocessors, microcontrollers, discrete electronic circuitry, software, firmware, and/or hardware that is capable of performing the algorithms discussed herein, as would be known to one of ordinary skill in the art. Sensor controller 94 determines which component of patient support apparatus 20 is controlled by the readings it receives from a particular force sensor 90 and then issues a command to communication network 78 instructing actuator controller 80 to move the corresponding component of patient support apparatus 20 in the desired direction.

Figure 10:
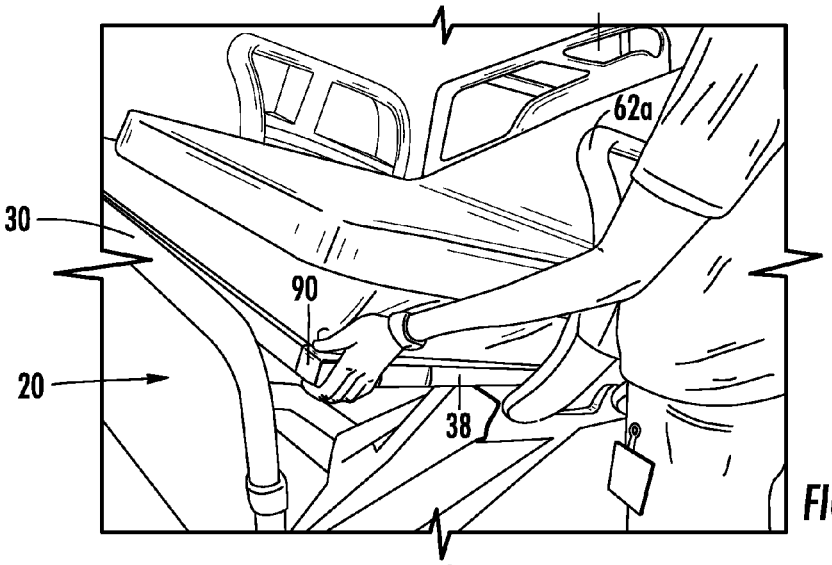
FIG. 10 is a perspective view similar to FIG. 9 showing a user applying an upward force to the control.
Figure 11:
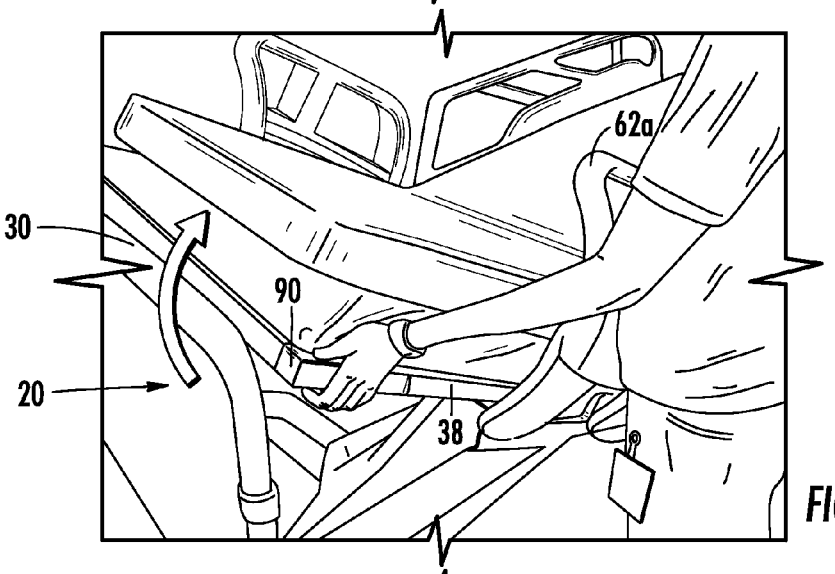
FIG. 11 is a perspective view similar to FIG. 9 showing the Fowler section raised to a higher position than in FIG. 10 after the user has applied the upward force.
Figure 12:
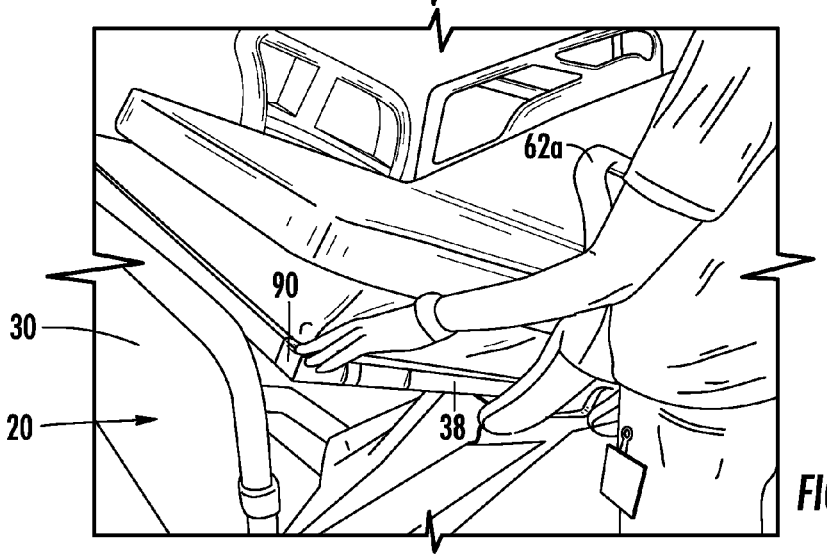
FIG. 12 is a perspective view similar to FIG. 11 showing the user applying a downward force to the control.

One example of the type of movement controlled by a sensor 90 is shown in FIGS. 10-12. In FIG. 10 a user is just beginning to push upward on a force sensor 90 attached to head section 38. In FIG. 11, the head section 38 has been pivoted to a higher orientation due to an actuator (not shown) pivoting head section 38. In FIG. 12, a user has pushed downward on the same force sensor 90 of FIGS. 10-11, and the actuator has begun to pivot head section 38 downwardly. Thus, while force sensor 90 requires a force to be exerted by a user, the amount of force necessary to activate the force sensor 90 and cause sensor controller 94 to issue movement commands to controller 80 is substantially less than the amount of force that would otherwise be necessary for a person to manually move the component that is being controlled. Thus, the amount of upward force exerted by the user in FIGS. 10-11 is substantially less than what would be required if the user had to physically pivot head section 38. The same is true for lowering head section 38 (FIG. 12). Thus, the use of force sensors 90 and sensor controller 94 provides a sort of assisted movement in which a person pushes or pulls on patient support apparatus 20 at a location they want to move, and such movement occurs but is performed by one or more actuators so that a user only has to apply a minimal force in the direction of movement.

As was noted above, the patient support apparatus embodiments that include control system 186 may or may not also include load cells 48. In those embodiments that do include load cells 48, some embodiments also have the load cells control movement of the patient support apparatus, while some other embodiments do not use the load cells 48 for movement control. In those embodiments that do use load cells 48 for movement control, the patient support apparatus has multiple different ways of controlling movement of the components of the support apparatus. For example, in one embodiment, in addition to controlling movement via any of the siderail control panels 64 or footboard control panel 84, movement of components of the patient support apparatus is achievable both by pushing on force sensor 90, as well as pushing on a component of support apparatus 20 that causes an imbalanced load to be detected by load cells 48. Still further, as will be explained below, some embodiments of patient support apparatus 20 allow some components to be controlled by gestures and/or wireless control signals.

Figure 8:
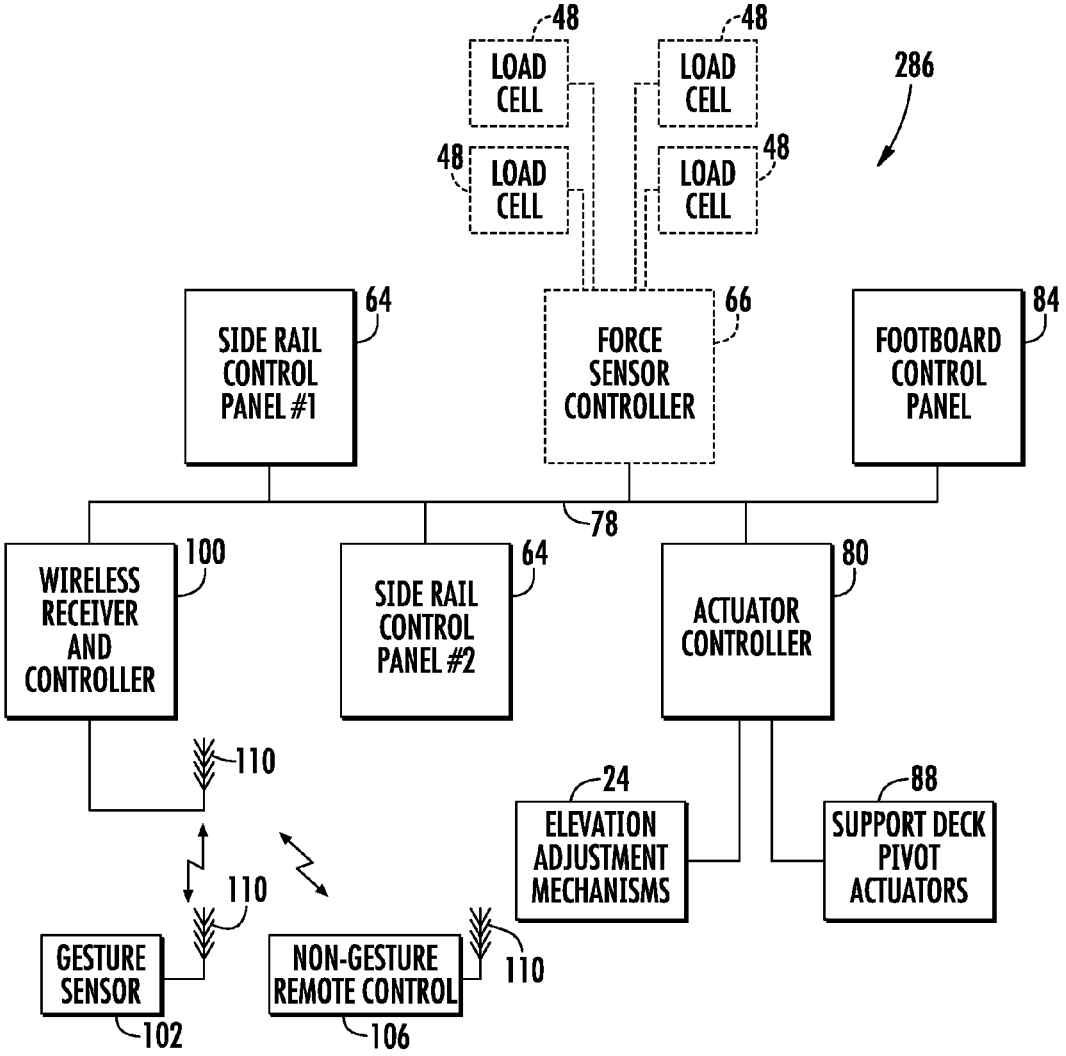
FIG. 8 is a diagram illustrating an electronic control system for a patient support apparatus according to yet another embodiment of the present invention.

FIG. 8 depicts another embodiment of an electronic control system 286 for a patient support apparatus. In the embodiment of FIG. 8, electronic control system 286 has been modified from the systems 86 and 186 of FIGS. 6 and 7, respectively, by the addition of a wireless receiver and controller 100, by the addition of at least one gesture sensor 102 or remote control 106, and by the rendering of force sensor controller 66 an optional component (signified by the dashed lines). That is, similar to control system 186, control system 286 may or may not include force sensor controller 66. Further, if control system 286 does include sensor controller 66, sensor controller 66 may or may not be used in controlling the movement of one or more components of patient support apparatus 20, depending upon the specifics of the embodiment implemented. That is, in some embodiments, control system 286 includes a force sensor controller 66 that only processes the outputs of load cells 48 for determining bed exit conditions and/or patient weight (i.e. controller 66 does not output any move commands to network 78). In other embodiments, control system 286 includes a force sensor controller 66 that does output move commands to network 78 in the manners described above, such as, but not limited to, outputting commands for raising or lowering the height of frame 26 with respect to base 22. In such embodiments of control system 286, force sensor controller 66 can, but do not necessarily need to, additionally process the outputs of load cells 48 for determining bed exit alerts and/or for determining patient weight. Still further, control system 286 may be modified further to include sensor controller 94 and one or more sensors 90 that operate in the manner described above, if desired.

Wireless receiver and controller 100 adds another way of controlling movement of components of patient support apparatus 20. In summary, wireless receiver and controller 100 receives signals from either or both of a gesture sensor 102 or a non-gesture remote control 106. Gesture sensor 102 detects one or more gestures of a caregiver, or other authorized individual, while non-gesture remote control 106 includes controls that enable a caregiver to remotely control one or more functions of patient support apparatus 20. Depending upon the specific gesture that is detected gesture sensor 102, wireless receiver and controller 100 outputs a command to actuator controller 80 (such as via communication network 78, or by other means) to cause movement of one or more components of patient support 20 in the corresponding manner. Thus, for example, the gesture of a caregiver raising or lowering his or her arm or hand could be correlated to raising or lowering, respectively, head section 38 of patient support apparatus 20. Alternatively, raising or lowering the hand or arm of a caregiver could be correlated to raising or lowering, respectively, frame 26 with respect to base 22. Still other types of gestures could be used for controlling any components of patient support apparatus 20.

In still other embodiments, one or more gestures are used for controlling aspects of patient support apparatus 20 that do not involve movement, such as arming or disarming an alert system, locking or unlocking a brake, turning on or off a motion control lockout, or still other functions. The arming or disarming of the alert system could be a bed exit alert system, or it could be an alert system based upon a set of one or more bed parameters, such as the alert system disclosed in commonly assigned U.S. Pat. publication 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosure of which is incorporated herein by reference.

Gesture sensor 102 may take on a variety of different forms. In one embodiment, gesture sensor 102 is a camera, or a plurality of cameras, that visually detect the movement and/or gestures of a caregiver or other authorized individual. In another embodiment, gesture sensor 102 includes any one or more of the sensors disclosed in commonly assigned, copending U.S. patent application Ser. No. 13/242,022 filed Sep. 23, 2011 by applicants Derenne et al. and entitled VIDEO MONITORING SYSTEM, the complete disclosure of which is hereby incorporated herein by reference.

Figure 13:
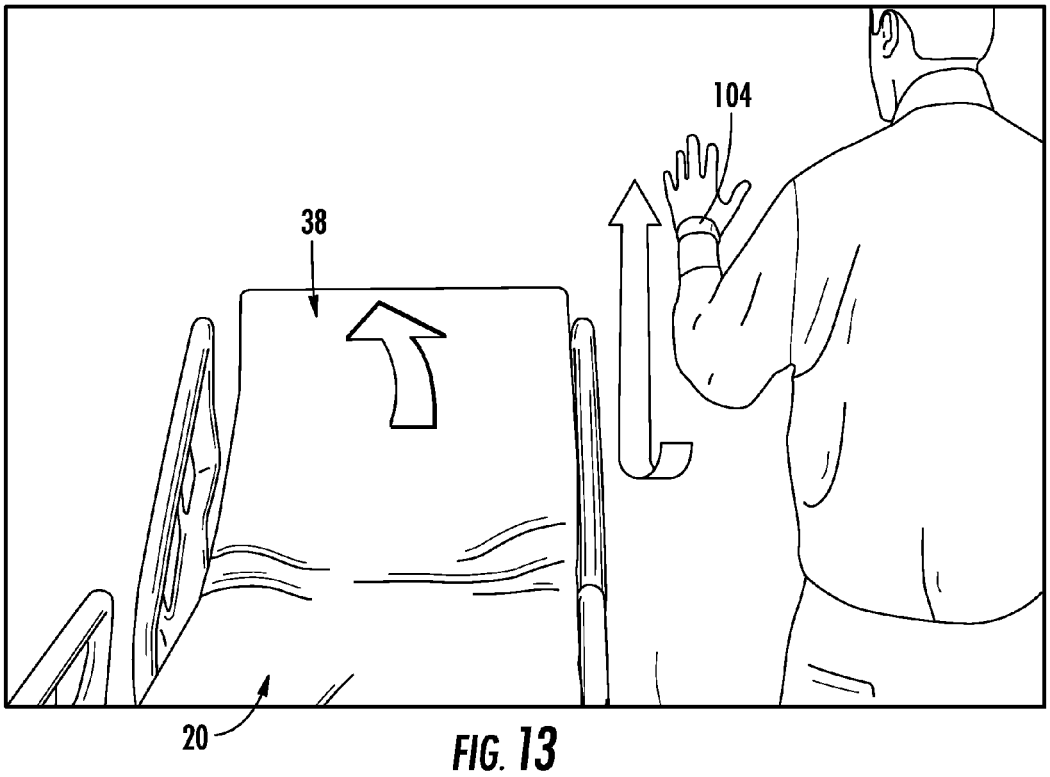
FIG. 13 is a perspective view of a user wearing a wrist control and moving his arm upward to control the pivoting of a Fowler section of a patient support apparatus.
Figure 14:
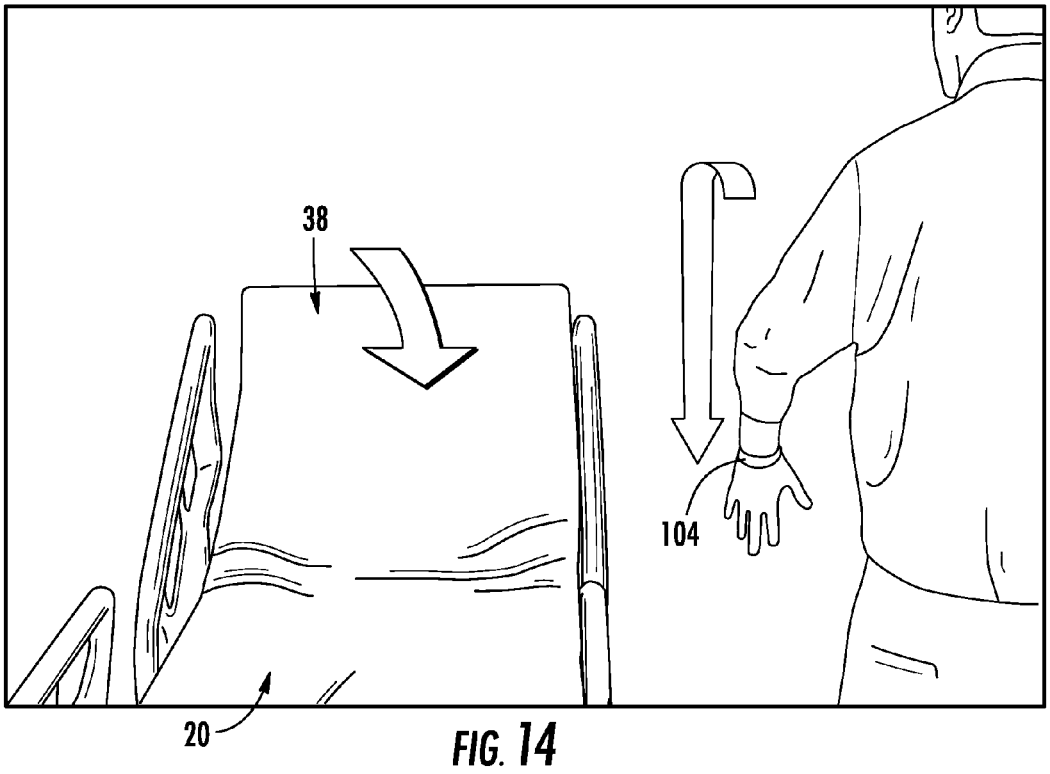
FIG. 14 is a perspective view similar to that of FIG. 13 showing a user moving his arm downward to control the pivoting of the Fowler section of the patient support apparatus.
Figure 15:
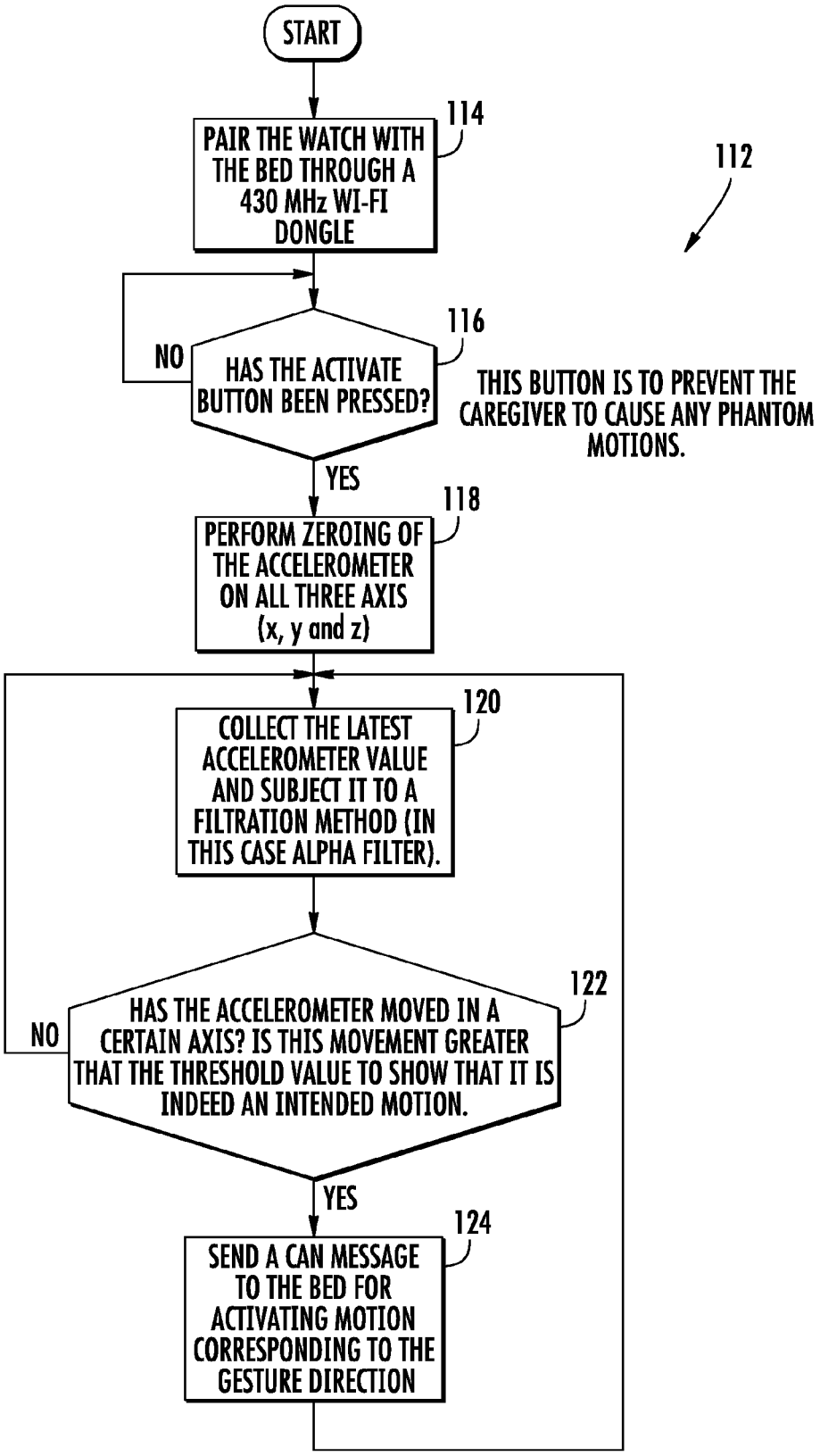
FIG. 15 is a flowchart of an illustrative algorithm that may be used for controlling movement of a portion of a patient support apparatus based upon non-contact movement of a user.

In the embodiment shown in FIGS. 13-15, gesture sensor 102 is a wristband 104 that includes a plurality of accelerometers (not shown), although it will be understood that other types of sensors that can detect motion can be used. The readings from the accelerometer are analyzed by a processor or controller that is attached to the wristband 104. Alternatively, the raw readings from the accelerometers may be transmitted wirelessly to wireless receiver and controller 100 without further processing. Regardless of where the processing is done, the accelerometer readings are processed to sense the direction and speed of motion of wristband 104. This direction and speed of motion is used to control movement of a component on patient support apparatus 20.

For example, the raising of the user's hand to which wristband 104 is attached, such as is shown in FIG. 13, could be used to raise head section 38 of patient support deck 28. Similarly, the lowering of the user's hand on which wristband 104 is attached could be used to lower head section 38. Alternatively, the pivoting of head section 38 could take place only when wristband 104 is likewise pivoting. In other words, merely changing height, without changing orientation, might be insufficient, in some embodiments, to cause any pivoting of head section 38. Still further, in some embodiments, changes in height only could control different components than changes in both height and orientation. As an example, in one embodiment, a user who changes the orientation wristband 104 could cause a corresponding pivoting of head section 38, while a user who merely changed the height of wristband 103 could cause a corresponding change in the height of frame 26. Other components of patient support apparatus 20—such as, but not limited to, siderails 62—could also, or alternatively, be controlled by the movement of wristband 104

In addition to accelerometers, or other motion detectors, wristband 104 may also include one or more buttons, switches, or other user-actuatable controls for controlling additional aspects of patient support apparatus 20. That is, wristband 104, in one embodiment, combines the functions of both gesture sensor 102 and remote non-gesture remote control 106 into a single unit. The remote controls that may be incorporated into either wristband 104 or remote control 106 could, for example, be used to control any one or more of the following aspects of patient support apparatus 20: turning on/off a brake; turning on/off an alert system; turning on/off a patient control lock-out; controlling any aspects of a scale system built into patient support apparatus 20; setting or otherwise controlling patient protocol reminders; or remotely controlling any of the functions associated with any of the controls on footboard control panel 84 and/or siderail control panels 64. Wristband 104 and/or remote control 106 would therefore allow a caregiver to remotely control patient support apparatus 20 without having to touch any portion of patient support apparatus 20, which could be advantageous in helping to control the risk of infection. It will of course be understood by those skilled in the art that such controls for remotely controlling patient support apparatus 20 could be incorporated into other types of sensors or structures besides wristband 104, such as, but not limited to, laptops, computer tablets, keypads, cell phones having Bluetooth or other wireless technology (and including an appropriate bed control app.), and/or any other structures capable of housing the appropriate electronic circuitry for remotely controlling patient support apparatus 20.

Although FIG. 8 shows wireless receiver and controller 100 of control system 286 as working with both gesture sensor 102 and non-gesture remote control 106, it will be understood by those skilled in the art that control system 286 may be implemented to communicate with only one of sensor 102 or remote control 106. That is, in some embodiments, patient support apparatus 20 will only be able to be controlled by gesture sensor 102 (and, of course, the control panels, if present), while in other embodiments patient support apparatus 20 will only be able to be controlled by remote control 106 (and the control panels). Still further, in some embodiments, patient support apparatus 20 is configured to be controlled by both gesture sensor 102 or remote control 106 (as well as the control panels).

Regardless of the physical form of gesture sensor 102 and/or remote control 106 (i.e. whether it is a wristband, a computer tablet, or something else), both gesture sensor 102 and remote control 106 are configured to be able to control multiple patient support apparatuses, rather than only a single patient support apparatus. Thus, a caregiver who enters a first room of a healthcare facility and then later moves to a second room of a healthcare facility is able to control the patient support apparatuses in both rooms with the same gesture sensor 102 and/or remote control 106. This frees the caregiver from having to carry multiple different gesture sensors and/or remote controls while moving from patient to patient. In those situations where multiple patient support apparatuses 20 were positioned in the same room, a selection mechanism is included on gesture sensor 102 or remote control 106, and/or on the support apparatuses themselves, enabling the desired one of the multiple support apparatuses to be remotely controlled.

In any of the various embodiments, gesture sensor 102 and remote control 106 communicate wirelessly with control system 286 of patient support apparatus 20. Such wireless communication takes place through a plurality of antennas 110, one of which is coupled to controller 100 and the other two of which are coupled, respectively, to gesture sensor 102 and remote control 106. The wireless communication takes place using any suitable electromagnetic frequency, and any suitable communication protocol. For example, in one embodiment, such communication takes place via infrared signals. In another embodiment, short wavelength radio transmissions such as found in Bluetooth devices, are used. In other embodiments, any communications based on, or using, the IEEE 802 standard, such as ZigBee, is used for such communications. In still other embodiments, other types of communication are used.

Gesture sensor 102 and/or remote control 106 include a suitable form of an on-off switch that enables or disables the ability of the sensor 102 or control 106 to control a patient support apparatus. Such a switch may be positioned on the sensor 102 or control 106, and/or it could be on the patient support apparatus. Such a switch may be configured to be manually changed from one state to the other, and/or it may be configured to be automatically changed based upon predefined conditions. The presence of such a switch helps prevent functions and/or movement of the patient support apparatus from being inadvertently controlled based upon normal gestures that are not intended for control purposes, and/or inadvertent manipulation of remote control 106.

FIG. 15 illustrates one example of a gesture control algorithm 112 that is used by controller 100 in conjunction with gesture sensor 102. At a first step, the patient support apparatus 20 is paired with gesture sensor 102 via a communication mechanism. In the specific embodiment shown in FIG. 15, patient support apparatus 20 is a bed and gesture sensor 102 is a watch-like structure attached to a wristband that is worn by a caregiver. Further, in the example of FIG. 15, the watch gesture sensor 102 communicates with the bed (patient support apparatus) via a 430 MHz Wi-Fi dongle that is plugged into an appropriate port on the bed. The dongle may be a Universal Serial Bus (USB) dongle, or another type of dongle, or it may be another type of connector. In a first embodiment, the dongle contains all of the electronic circuitry that comprises controller 100, while in a second embodiment it contains only a portion of the circuitry of controller 100. The port on the bed to which the dongle plugs is a port that is in electrical communication with communication network 78 on the bed. The dongle therefore sends and receives communications over internal wiring on the bed to or from the various controllers that are communicatively coupled together via network 78.

At a next step 116 (FIG. 15), electronic circuitry in the watch (gesture sensor 102) determines whether an on-off switch on the watch has been turned on. If so, control proceeds to step 118. If not, control returns back to step 116 for periodic re-checking of the status of the on-off button. At step 118, the accelerometers within the watch (gesture sensor 102) are zeroed on all three axes (x, y, and z). Control then proceeds to step 120 where the values of the accelerometers are read. Further, step 120 may include a filtering component in which the values that are read from the accelerometers are passed through an appropriate filter. In one embodiment, the filter may be an alpha beta filter. In another embodiment, the filter may be a Kalman filter. In still other embodiments, other filters may be used.

At a next step 122, circuitry within gesture sensor 102 determines whether any of the accelerometers have moved along a certain axis and, if so, whether the movement is greater than a threshold amount. The threshold amount is chosen to eliminate small movements that may naturally be generated by the caregiver wearing gesture sensor 102 and which are not intended to change anything on patient support apparatus 20 (e.g. the bed in this example). If movement exceeding the threshold is detected, then gesture sensor 102 sends a message to controller 100 at a step 124 indicating that movement of the bed should occur. Such a message takes on any suitable form, and such a message may be in a format that matches the format used for communication network 78. In the example of FIG. 15, for example, the communication network 78 is a CAN network, and the message generated as a result of the movement of gesture sensor 102 is formatted in the CAN format. The formatting may take place via circuitry on gestures sensor 102, or via circuitry within controller 100. However formatted, once the message is placed on communication network 78, it is picked up by the appropriate controller, such as actuator controller 80, for controlling the movement and/or other aspect of the bed.

In carrying out algorithm 112, or any other gesture control algorithm, the movement of the gesture sensor 102 may be subjected to further processing and/or speed limits that facilitate the control of patient support apparatus 20. For example, movement that exceeds a speed threshold are ignored. Such speed thresholds are useful in situations where a caregiver's hands or arms have been moved to the end of that particular person's reach, yet the component of patient support apparatus 20 has not moved to its end position. In such cases—which are somewhat analogous to a computer user moving his or her computer mouse to the edge of the mouse pad but not having the cursor moved to the edge of the screen—the caregiver can quickly move his or her arm back to a less extreme position without causing the component of patient support apparatus to also move backward. Once moved back, the caregiver's hand or arm can continue to be moved in the desired direction at a slower speed to thereby cause the component to patient support apparatus 20 to move further in the desired direction. Thus, by moving his or her hand quickly, the caregiver can resolve situations where he or she has reached the end of their gesturing ability but wish to move a component of patient support apparatus 20 still further. Such speed limits thus are analogous to a computer user picking up the computer mouse and repositioning it so that further movement of the cursor in the desired direction can be performed.

It will be understood by those skilled in the art that, although FIG. 7 depicts a control system 186 having sensor controller 94 with no wireless receiver controller 100, in some embodiments patient support apparatus 20 is configured such that the control system includes both controller 94 and controller 100, thereby allowing patient support apparatus 20 to be able to be controlled both by gestures and/or by force sensors 90. Further, as has been noted, such embodiments may or may not include the ability to control the movement of patient support apparatus by forces detected by load cells 48.

It will also be understood by those skilled in the art that further modifications to the embodiments described herein may be made. As but one example, any of the control systems (86, 186, and/or 286) can be modified to include a mattress controller for controlling one or more features of mattress 36. By adding such a mattress controller to communications network 78, any of the force sensor controller 66, sensor controller 94, and/or wireless receiver and controller 100 are able to send commands over the network 78 that control one or more features of mattress 36. One or more features of mattress 36 can therefore be controlled by exerting forces on any portion of patient support (including, but not limited to, a force sensor 90 positioned on the mattress 36 itself), or by gestures detected by gesture sensor 102, or remotely by remote control 106. The connection between the mattress 36 and network 78 may be a wired connection, or it could be a wireless connection, such as disclosed in commonly assigned, copending U.S. patent application Ser. No. 13/296,656 filed Nov. 15, 2011, by applicants Lemire et al., and entitled PATIENT SUPPORT WITH WIRELESS DATA AND/OR ENERGY TRANSFER, the complete disclosure of which is hereby incorporated herein by reference. Further, patient support apparatus 20 could receive power wirelessly, as disclosed in this application (Ser. No. 13/296,656).

Any of electronic control systems 86, 186, and/or 286 may also be modified to include a gateway module, or similar type of module, that allows for communications with a healthcare computer system or network, such as a hospital Ethernet, or other facility computer network. Such communication could be wired or wireless. The gateway controller could be electrically coupled to electronic communication network 78 so that is could send and receive information from any of the electronic controllers, modules, or other devices that communicate over network 78. Information related to, or generated by, any of load cells 48, force sensors 90, gesture sensors 102, and/or remote control 106 can therefore be transmitted off of patient support apparatus 20 to a healthcare network. Any one or more software applications in communication with the network can then use this information in any desired manner, such as, for example, forwarding relevant information to an electronic medical record, or issuing an alert, or in other manners. Further, because the healthcare facility's network may be connected to the Internet, this information could be forwarded over the Internet to any desired location and/or computer system.

The gateway module may also be used to forward control signals to other entities besides the computer network of a healthcare facility. For example, the gateway module may act as an interface for controlling one or more aspects of the hospital room, or other room, in which the patient support apparatus 20 is located. Such other aspects include the lights in the room, a thermostat, a television, the opening or closing of window coverings, and other aspects. The gateway module can therefore provide electrical control signals to one or more electronic controllers located off of patient support apparatus 20 that automatically control these aspects.

Any of electronic control systems 86, 186, and/or 286 can further be modified to include a voice recognition controller that recognizes voice commands issued from a caregiver. Such a voice recognition controller could be electrically coupled to communication network 78 so that, after converting voice commands into command messages, such messages can be transmitted on network 78 to the appropriate controller (e.g. actuator controller 80, although other controllers could be the recipient of the voice information).

Still additional alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

What is claimed is:

1. A patient support apparatus comprising:

a base;

a frame positioned above said base;

a patient support surface supported on the frame, said patient support surface adapted to support a patient;

a plurality of force sensors adapted to detect forces exerted on the patient support surface;

a sensor adapted to detect a presence of an authorized individual within a vicinity of the patient support apparatus;

an actuator adapted to physically move a component of the patient support apparatus when actuated;

a control panel having a control for controlling the actuator; and a controller in communication with the plurality of force sensors, the control panel, the sensor, and the actuator, said controller adapted to actuate said actuator in response to the forces detected by the plurality of force sensors only if the sensor detects the presence of the authorized individual, and said controller further adapted to actuate said actuator in response to the control regardless of the presence of the authorized individual.

2. The apparatus of claim 1 wherein said patient support surface includes a pivotable head section that is pivotable by said actuator and said controller is adapted to pivot the head section, if the sensor detects the presence of the authorized individual, based upon forces detected by the plurality of force sensors.

3. The apparatus of claim 1 wherein said actuator is adapted to raise or lower a height of the frame relative to the base, and said controller is adapted to change the height of the frame relative to the base, if the sensor detects the presence of the authorized individual, based upon forces detected by the plurality of force sensors.

4. The apparatus of claim 1 wherein said controller is also adapted to determine a patient's weight while positioned on the patient support surface based on forces detected by said force sensors.

5. The apparatus of claim 4 wherein said patient support apparatus is a bed.

6. The apparatus of claim 1 wherein said controller analyzes the forces detected by the plurality of force sensors and distinguishes between forces resulting from a patient's weight and forces applied by a caregiver, said controller not actuating said actuator based upon forces resulting from the patient's weight.

7. The apparatus of claim 1 wherein said controller analyzes the forces detected by the plurality of force sensors to determine if a first total sum of forces sensed on a first side of the patient support exceeds a second total sum of forces sensed on a second side of the patient support by more than a first threshold, said controller actuating said actuator if said first total sum of forces exceeds said second total sum of forces and if said sensor detects the presence of the authorized individual.

8. The apparatus of claim 7 wherein said controller actuates said actuator if the first total sum of forces exceeds said second sum of forces for more than a threshold amount of time.

9. The apparatus of claim 1 wherein said controller analyzes the forces detected by the plurality of force sensors to determine if a first total sum of forces sensed on a first end of the patient support exceeds a second total sum of forces sensed on a second end of the patient support, said controller actuating said actuator if said first total sum of forces exceeds said second total sum of forces and if said sensor detects the presence of the authorized individual.

10. The apparatus of claim 1 further including an additional force sensor adapted to detect a force exerted by a caregiver on the patient support apparatus and positioned at a location such that the additional force sensor does not detect any forces due to a weight of the patient positioned on said patient support apparatus, said controller adapted to change—when sufficient force is applied to the additional force sensor—at least one of a height of said frame relative to said base and an orientation of a section of said patient support surface.

11. The apparatus of claim 1 wherein said support apparatus is one of a bed, a stretcher, a cot, a recliner, a chair, an operating table, and an examination table; and said plurality of force sensors are load cells.

12. The apparatus of claim 1 wherein said plurality of force sensors are load cells.

13. The apparatus of claim 12 wherein said patient support apparatus is a bed.

14. The apparatus of claim 13 wherein said component is a head section of said patient support surface and said actuator is adapted to pivot said head section about a generally horizontal pivot axis.

15. The apparatus of claim 13 wherein said component is said frame, and said actuator is adapted to change a height of said frame with respect to said base.

16. A patient support apparatus comprising:

a base;

a frame positioned above said base;

a patient support surface supported on the frame, said patient support surface adapted to support a patient;

a plurality of force sensors adapted to detect forces exerted on the patient support surface;

an actuator adapted to raise and lower a height of the frame relative to the base; and a controller in communication with the plurality of force sensors and the actuator, said controller adapted to actuate said actuator in response to the forces detected by the plurality of force sensors, and said controller further adapted to cause the actuator to lower the height of the frame if the controller determines that the patient positioned on the patient support surface may be about to exit the patient support surface.

17. A patient support apparatus comprising:

a base;

a frame positioned above said base;

a patient support surface supported on the frame, said patient support surface being moveable with respect to said base, and said patient support surface adapted to support a patient;

a first control adapted to generate a first signal based upon a first force applied to the first control in a first direction, and to generate a second signal based upon a second force applied to the first control in a second direction opposite said first direction;

a control panel having a second control;

a sensor adapted to detect a presence of an authorized individual within a vicinity of the patient support apparatus; and a controller in communication with the first control and the second control, said controller adapted to cause movement of said patient support surface in said first direction in response to said first signal if said sensor detects the presence of the authorized individual, said controller further adapted to cause movement of said patient support surface in said second direction in response to said second signal if said sensor detects the presence of the authorized individual, and said controller also adapted to cause movement of said patient support surface in said first or second direction in response to said second control regardless of the presence of the authorized individual.

18. The apparatus of claim 17 wherein said first control includes a load cell.

19. The apparatus of claim 18 wherein said load cell is positioned on one of a siderail and a head section of the patient support surface.

20. The apparatus of claim 17 wherein said first control is positioned on a head section of said patient support surface and pressing upward on said first control causes said head section to pivot upward if said sensor detects the presence of the authorized individual, and pressing downward on said first control causes said head section to pivot downward if said sensor detects the presence of the authorized individual.

21. The apparatus of claim 17 wherein said first control is positioned on said frame and pressing said first control upward causes said frame to move upward if said sensor detects the presence of the authorized individual, and pressing said first control downward causes said frame to move downward if said sensor detects the presence of the authorized individual.

22. The apparatus of claim 17 wherein said sensor detects the presence of the authorized individual by near field communication between said patient support apparatus and a device worn by the authorized individual.

23. The apparatus of claim 17 wherein said patient support apparatus is one of a bed, a stretcher, a cot, a recliner, a chair, an operating table, and an examination table.

24. The apparatus of claim 17 wherein said sensor detects the presence of the authorized individual by detecting an RF ID tag worn by the authorized individual.

* * * * *